US006444033B1

(12) United States Patent
O'Mara et al.

(10) Patent No.: US 6,444,033 B1
(45) Date of Patent: Sep. 3, 2002

(54) ARTICLE COMPRISING A DIFFUSER WITH FLOW CONTROL FEATURES

(75) Inventors: Kerry Dennis O'Mara, Hopewell Township, NJ (US); David Keller, Newtown, PA (US); Joseph Thomas McGinn, Flemington, NJ (US)

(73) Assignee: Delsys Pharmaceutical Corp., New Monmouth, NJ (US)

( * ) Notice: Subject to any disclaimer, the term of this patent is extended or adjusted under 35 U.S.C. 154(b) by 0 days.

(21) Appl. No.: 09/438,801

(22) Filed: Nov. 12, 1999

(51) Int. Cl.[7] ..... B05B 5/03; B05B 5/025
(52) U.S. Cl. ..... 118/621; 118/640
(58) Field of Search ..... 118/308, 620, 118/621, 623, 624, 668, 669, 629, 640

(56) References Cited

U.S. PATENT DOCUMENTS 4,098,073 A * 7/1978 Adkins et al. ..... 60/39.16 R
4,650,538 A * 3/1987 Simmonds, Jr. et al. .... 156/578
4,875,932 A * 10/1989 Uchiyama et al. ..... 73/202
5,173,325 A * 12/1992 Knobbe et al. ..... 427/476
5,279,863 A * 1/1994 Escallon ..... 427/477
5,454,640 A * 10/1995 Welker ..... 366/336
6,063,194 A * 5/2000 Poliniak et al. ..... 118/623

* cited by examiner

*Primary Examiner*—Richard Crispino
*Assistant Examiner*—Yewebdar T Tadesse
(74) *Attorney, Agent, or Firm*—DeMont & Breyer, LLC; Wayne S. Breyer; Jason Paul DeMont

(57) ABSTRACT

A diffuser comprises a conduit having a cross-sectional area that increases in a direction fluid flow. In one embodiment, the diffuser is used to reduce the incidence and severity of flow fluctuations that occur in an electrostatic deposition apparatus. In some embodiments, the diffuser includes one or more flow control features. A first flow-control feature comprises one or more appropriately-shaped annular slits through which fluid having a greater momentum than a primary fluid moving through the diffuser is injected into the "boundary layer" near the wall of the diffuser. A second flow control feature comprises one or more annular slits or, alternatively, slots or holes that are disposed at appropriate locations around the circumference of the diffuser through which a portion of fluid flowing in the boundary layer is removed. Boundary-layer flow removal is effected, in one embodiment, by creating a pressure differential across such annular slit or slots. Among other benefits, such flow control features reduce any tendencies for flow separation of the primary fluid in the diffuser.

26 Claims, 16 Drawing Sheets

1A 272
8
302
214
550
526
532
530
544
526
534
542
524
546
521
528
518
550
548
548
540
522
548
520
517
416

ARTICLE COMPRISING A DIFFUSER WITH FLOW CONTROL FEATURES

STATEMENT OF RELATED APPLICATIONS

The present invention is related to International Application No. PCT/US99/12772 filed Jun. 8, 1999 entitled "Pharmaceutical Product and Methods and Apparatus for Making Same."

FIELD OF THE INVENTION

The present invention relates to improvements in an apparatus for the manufacture of pharmaceutical products.

BACKGROUND OF THE INVENTION

In the pharmaceutical industry, pharmaceutical products are typically embodied as tablets, caplets, test strips, capsules and the like. Such products, which include diagnostic products, include one or more "unit dosage forms" or "unit diagnostic forms" (collectively "unit forms").

Each of the unit forms typically contains at least one pharmaceutically- or biologically-active ingredient (collectively "active ingredient") and, also, inert/inactive ingredients. Such active and inactive ingredients, typically available as powders, are suitably processed to create the unit forms.

In the above-referenced International Patent Application, which is incorporated herein by reference, applicant discloses an apparatus for manufacturing such unit forms. The apparatus utilizes an electrostatic deposition process whereby powder(s) containing active and/or inactive ingredients are deposited on a substrate at discrete locations thereby producing the unit forms. To provide context for the present invention, the deposition apparatus, its operation, and illustrative unit forms produced thereby are described below.

FIGS. 1–4 depict one embodiment of a unit form 6 produced by the electrostatic deposition apparatus. FIG. 1 depicts a plurality of such unit forms 6 arrayed on a strip 4. In the illustrated embodiment, strip 4 comprises a substrate 8 and a cover layer 10, each of which comprise a substantially planar, flexible film or sheet. In some embodiments, one of either substrate 8 or cover layer 10 include an array of semi-spherical bubbles, concavities or depressions (hereinafter "bubbles") 12 that are advantageously uniformly arranged in columns and rows.

Unit form 6 comprises active ingredient 14, a portion of cover layer 10 defining bubble 12, and a region of substrate 8 within bonds 7. FIG. 2 (showing cover layer 10 partially "peeled" back from substrate 8) and FIG. 3 (showing a cross section of a portion of strip 4) depict a deposit of dry active ingredient 14, in the form of a powder, disposed between substrate 8 and cover layer 10 within bubble 12. FIG. 3 and FIG. 4 (showing a top view of a unit form 6) depict substrate 8 and cover layer 10 attached to one another via bonds 7 that are near to and encircle bubble 12.

Deposition Apparatus

FIG. 5 depicts, via a high-level block diagram, deposition apparatus 1 suitable for making unit form 6. Apparatus 1 comprises platform 102 wherein unit forms 6 are produced. Platform 102 performs a variety of operations including the electrostatic deposition of dry powder on defined discrete regions of a substrate, materials handling, alignment operations, measurement operations and bonding operations.

Electrostatically-charged powder is delivered to platform 102 for deposition via powder feed apparatus 402. In some embodiments, platform 102 and/or powder feed apparatus 402 are isolated from the ambient environment by an environmental enclosure. In such environments, environmental controller EC provides temperature, pressure and humidity control for platform 102 and powder feed apparatus 402. Further description of platform 102 and powder feed apparatus 402 is provided later in this section.

Processor P and controller C control various electronic functions of apparatus 1, such as, for example, the application of voltage for the electrostatic deposition operation, the operation of powder feed apparatus 402, the operation of robots that are advantageously used in conjunction with platform 102, and dose measurement operations. To facilitate such control functions, memory M is accessible to processor P and controller C.

FIGS. 6 and 7 depict a top view and a front elevational view, respectively, of illustrative platform 102. In some embodiments, platform 102 comprises bench 214 that incorporates five processing stations that perform various operations used to produce the present product. Briefly, those processing stations include: storage station 220, which advantageously comprises three substations 220A, 220B and 220C for storing substrates and cover layers; alignment station 230 for assuring that the substrate and cover layer are properly adhered to a transport mechanism (e.g., robotic elements) that delivers them to other processing stations; deposition station 250 where powder is deposited on the substrate; dose measurement station 240 for measuring the amount of powder that is deposited on the substrate; and lamination station 260 where the cover layer is laminated to the substrate.

As depicted in FIG. 7, four supports 216 elevate bench 214 above a table or like surface. Additionally, supports 216 advantageously provide a frame or superstructure for optional side-mounted barriers 218, depicted in FIG. 6. The side-mounted barriers, in conjunction with a top barrier (not shown) and bench 214 define an environmental enclosure or chamber that isolates the region therein from the ambient environment under air or inert gas.

To facilitate the various processing operations, as well as materials handling between the processing stations, platform 102 advantageously includes a transport means. In the embodiment illustrated in FIG. 7, the transport means is a robotic system that includes first robotic transport element 270 and second robotic transport element 280 that are movable along first rail 290. First rail 290 functions as a guide/support for movement in one direction (e.g., along the x-axis). An additional rail (not shown) movably mounted on first rail 290 functions as a guide/support for movement in a direction orthogonal to but in the same plane (e.g., the y-axis) as first rail 290. Such rails collectively provide x-y motion. Drive means (not shown), such as x-y stepper motors, move robotic transport elements 270 and 280 along the rails.

Receiver 272 is attached to first robotic transport element 270 and "bonding" head 282 is attached to second robotic transport element 280. Receiver 272 is operable to retrieve at least the substrate from the substation where it is stored (i.e., 220A or 220B or 220C) and to move it to at least some of the various operational stations 230–260 for processing. Bonding head 282 is operable to join/seal the substrate and cover layer to one another to create the unit forms 6.

First and second robotic transport elements 270 and 280 have telescoping components under servo control (not shown) that provide movement along the z axis (i.e., normal to the x-y plane). Such z-axis movement allows receiver 272 and bonding head 282 to move "downwardly" toward a processing station to facilitate an operation, and "upwardly" away from a processing station after the operation is completed.

Moreover, robotic transport elements 270 and 280 advantageously include θ control components under servo control (not shown) that allow receiver 272 and bonding head 282 to be rotated in the x-y plane as may facilitate operations at a processing station. Compressed dry air or other gas is suitably provided to operate the robotic transport elements. Robotic transport elements 270 and 280 can be based, for example, on a Yaskawa Robot World Linear Motor Robot available from Yaskawa Electric Company of Japan.

As previously indicated, powder comprising an active ingredient is electrostatically deposited at discrete locations on substrate 8 at deposition station 250. In the illustrated embodiments, accomplishing such deposition requires that, among other things, substrate 8 is transported to deposition station 250 from some other location, and that an electrostatic charge is developed that causes the powder to electrostatically deposit on substrate 80. Such transport and charging operations are facilitated, at least in part, via receiver 272 and electrostatic chuck 302.

FIG. 8 depicts a view of first surface 304 of electrostatic chuck 302. Electrostatic chuck 302 comprises a layer 303 of dielectric material. The electrostatic chuck has a thickness of about 0.01 inches (0.25 mm), and, as such, is relatively flexible. Illustrative electrostatic chuck 302 has "through holes" ECH implemented as slots that are disposed at its periphery. First surface 304 further includes a plurality of powder collection zones CZ. In illustrative electrostatic chuck 302, collection zones CZ are advantageously organized in eight columns $\mathbf{306}_{C1\text{-}C8}$ of twelve collection zones each for a total of ninety-six collection zones CZ. As will be described in further detail later in this specification, each collection zone CZ corresponds to a powder deposition location on the substrate (see substrate 8 in FIG. 1). Collection zones CZ are formed within electrostatic chuck 302 by an arrangement of dielectric and conductive regions, several embodiments of which are described later in this section in conjunction with FIGS. 10*a*–10*c*.

FIG. 9 depicts a view of second surface 308 of electrostatic chuck 302. As depicted in more detail in FIGS. 10*a*–10*c*, collection zones CZ are formed via electrical contact pads 310. Such electrical contact pads 310 provide contact points for connection to a controlled voltage source.

Electrical contact pads 310 are electrically connected to selected other electrical contact pads via address electrodes 312. By virtue of such groups of selected electrical connections (e.g., the pads 310 within a given column $\mathbf{306}_{C1\text{-}C8}$ of illustrative chuck 302 of FIG. 9 defines an illustrative grouping), a first voltage can be applied to contact pads 310 in column $\mathbf{306}_{C1}$, while a second voltage different from the first voltage can be applied to contact pads 310 in second column $\mathbf{306}_{C2}$, and so forth varying the voltage applied to contact pads 310 on a column-by-column basis as desired. It will be understood that the application of such different voltages to such different columns results in depositing a different amount of powder at collection zones CZ in each of such columns. In other embodiments, address electrodes are arranged differently thereby creating electrical interconnects between differently-arranged groupings of contact pads 310. For the layout of contact pads 310 and address electrodes 312 depicted in FIG. 9, voltage need only be applied to a single contact pad 310 within a given column 306 to develop substantially the same electrostatic charge at each contact pad 310 within that column.

FIGS. 10*a*–10*c* depict several illustrative embodiments of structural arrangements suitable for forming collection zones CZ within an electrostatic chuck, such as electrostatic chuck 302. For clarity of illustration, the structure associated with only a single collection zone CZ of an electrostatic chuck is depicted in FIGS. 10*a*–10*c*.

In a first embodiment depicted in FIG. 10*a*, a conductive material 314 is disposed through layer 303 of dielectric at each region designated to be a collection zone CZ. The conductive material overlays a portion of first surface 304 and second surface 308 of the electrostatic chuck. The portion of conductive material 314 overlying first surface 304 comprises a powder-attracting electrode 316A, while the portion of conductive material 314 overlying the second surface 308 comprises electrical contact pad 310A (which is one embodiment of electrical contact pad 310 previously mentioned). A shield electrode 318 (also termed a "ground electrode" based on a preferred bias) is disposed within layer 303.

Applying a voltage to electrical contact pad 310A generates an electrostatic field at powder-attracting electrode 316A at collection zone CZ. As described later in this section, the electrostatic field attracts charged powder to the substrate 8 that engages first surface 304 of the electrostatic chuck. Additionally, the electrostatic field aids in holding substrate 8 flat against first surface 304. Tight adherence of the substrate 8 to the electrostatic chuck increases the reliability, consistency, etc., of powder deposition at the collection zones. A reduced pressure that is developed in receiver 272 to which the substrate 8 is exposed also assists in adhering the substrate to the electrostatic chuck.

FIG. 10*b* depicts a second illustrative embodiment where via hole V is formed at electrical contact pad 310B and powder-attracting electrode 316B. FIG. 10*c* depicts a third illustrative embodiment wherein an additional layer 305 of dielectric material separates powder-attracting electrode 316C from substrate 8. Electrical contact-pad 310C overlays second surface 308.

The electrostatic chuck provided by the configuration depicted in FIG. 10*c* can be termed a "Pad Indent Chuck" which is useful, for example for powder depositions of less than about 2 mg, preferably less than about 100 μg, per collection zone CZ (assuming, for example, a collection zone having a diameter within the range of 3–6 mm diameter). The electrostatic chuck provided by the configuration depicted in FIG. 10*a* can be termed a "Pad Forward Chuck" which is useful, for example, for powder depositions of more than about 20 μg per collection zone CZ (again assuming a collection zone of about 3–6 mm diameter). The Pad Forward Chuck is more useful than the Pad Indent Chuck for higher dose depositions.

As described further below, electrostatic chuck 302 is engaged to receiver 272 during at least some deposition-apparatus operations (e.g., during electrostatic deposition of powder on the substrate 8). FIG. 11 depicts underside 274 of receiver 272 with electrostatic chuck 302 adhered thereto. Electrostatic chuck 302 has alignment features 320, such as pins or holes, by which it is aligned to complementary holes or pins (not shown) in the receiver. Also depicted are alignment pins 276 that are received by complementary holes in bench 214 for aligning receiver 272 to various processing stations (e.g., deposition station 250). Height-adjustable vacuum cups 278 are advantageously used to attach an alignment frame (not shown), which can be used in conjunction with the substrate, to the receiver.

The powder deposition process proceeds via electronic control of electrostatic chuck 302. As previously described, the deposition apparatus 1 advantageously includes central processor P and controller C for performing calculations, control functions, etc. (see FIG. 5). Processor P receives performance input from multiple sources, including, for example, on-board sensors and historical data from dose measurement station 240, and uses such information to determine if operating parameters should be adjusted to keep powder deposition within specification. Such input includes, for example, data pertaining to the rate of powder flux into and through the deposition engine (made up of powder feed apparatus 402 and deposition station 250) and the degree to which powder is being evenly deposited at electrostatic chuck 302. The "on-receiver" electronics described below, either alone or in conjunction with processor 401 and controller 403, provide a means for adjusting apparatus 1 during operation.

In embodiments in which processor P has primary responsibility for processing functions, a secondary processor (not shown) located in receiver 272 functions as a communications board that receives commands from processor P and relays such commands to an addressing board (not shown), also located in receiver 272. The addressing board then sends bias control signals (DC or AC signals) for controlling the voltage applied to electrical-contact pads 310. Depending upon the addressing scheme (e.g., the arrangement, if any, by which individual electrical-contact pads 310 are electrically interconnected via address electrodes 312), voltage is either regionally (e.g., by columns, rows, etc.) or individually applied.

The addressing board preferably has multiple channels of synchronized output (e.g., square wave or DC). The signals sent to the addressing board can be encoded, for example, with a pattern of square wave voltage pulses of varying magnitudes to identify a particular electrical-contact pad/powder-attracting electrode, or a group of such electrodes, together with the appropriate voltage to be applied thereto.

The bias control signals are sent via a high voltage board (not shown), which advantageously has multiple channels of high-voltage converters (transformers or HV DC-to-DC converters) for generating the voltages, such as 200 V or 2,500 V or 3,000 V (of either polarity), that energizes powder-attracting electrodes 310. The high voltage board is advantageously located in receiver 272 so that other systems are isolated therefrom.

In some embodiments, the "secondary" on-receiver processor receives data directly from "charge" sensors (not shown) that are positioned on or adjacent to electrostatic chuck 302. Such sensors monitor the amount of powder being deposited. The on-receiver processor locally interprets and responds to data from such sensors by suitably adjusting the voltage applied to the electrical contact pads/powder-attracting electrodes.

Operation of the Deposition Apparatus

In operation, first robotic transport element 270 moves receiver 272 and electrostatic chuck 302 adhered thereto (see FIG. 11) to storage station 220. At station 220*a*, electrostatic chuck 302 engages a "virgin" substrate and, in some embodiments, also engages an alignment frame (not shown) that is joined to the substrate.

In one embodiment, after engagement, robotic transport element 270 moves receiver 272, electrostatic chuck 302, the substrate and frame to alignment station 230. At the alignment station, the substrate is brought into contact with a pad (e.g., urethane foam, etc.). Such contact advantageously smoothes the substrate against electrostatic chuck 302. After the substrate is smoothed against the substrate, a suction force is applied that holds the substrate against electrostatic chuck 302. Flattening and smoothing the deposition surface (ie., the substrate) in such manner improves the consistency of the powder deposits thereon.

Robotic transport element 270 then moves engaged receiver 272, electrostatic chuck 302, the substrate and frame to dose measurement station 240. After aligning with a measurement apparatus 242 at station 240, the substrate is scanned via a measurement device and distances from a reference point to the substrate at each collection zone CZ (see FIGS. 8, 10*a*–10*c* and 11) are calculated and recorded to provide baseline data.

Robotic transport element 270 then moves engaged receiver 272, electrostatic chuck 302, the frame and virgin substrate to deposition station 250. At deposition station 250, the substrate abuts gasket 259 that frames deposition opening 258 (see FIG. 6). The powder deposition engine (see FIG. 13) is turned on and powder is electro-deposited through deposition opening 258 on the substrate at regions overlying the electrostatic chuck's collection zones CZ.

At the completion of the powder-deposition operation, robotic transport element 270 returns the substrate, with its complement of discreetly deposited powder, to dose measurement station 240. At that station, the measurement device again scans the substrate to, determine the distance between the reference point to the surface of each "deposit" of powder. From such distances, and the previously obtained baseline data, the amount (e.g., volume) of powder in each deposition is calculated. If the calculated amount is outside a desired range of a predetermined target amount, such information is displayed. An operator can then suitably adjust operating parameters to bring the process back into specification. In another embodiment, automatic feed back is provided to automatically adjust the process, as required. The "out-of-spec" unit forms may be discarded.

Regarding dose measurement, either one or both of two optical measurement methods may be used: diffuse reflection and optical profilometry, both of which methods are known in the art.

The diffuse reflection method is based on reflecting or scattering a probe light beam, such as a laser beam, off of the powder surface in directions that are not parallel to the specular reflection direction. Applicants have discovered that measurements obtained based on diffuse reflection using non-absorbing radiation provide a strong correlation with the deposited amount of powder in a unit form, at least up to a certain amount. The limiting amount varies with the character of the powder and is believed to correspond to an amount of powder that prevents light penetration into lower layers.

Diffuse reflection in a non-absorbing region provides good accuracy in measuring dose deposition amounts ranging from 50–400 $\mu$g, or even as high as 750 $\mu$g to 1 mg, for a 3 or 7 mm deposition "dot," depending on the characteristics of the powder. The diffuse reflection method can detect substantially less than a mono-layer of powder. If the deposit is more than a mono-layer, the probe light beam must partially penetrate the upper layers so that it can be affected by the reflection off of the lower layers to provide an accurate measurement. There tends, however, to be a practical limit (dependent upon the powder) to deposition thickness for it to exhibit "Lambertian" characteristics required for measurement via diffuse reflection. Diffuse reflection is also a measure of the physical uniformity of the dose deposits at the above-listed ranges.

Optical profilometry is useful for obtaining dose measurements that are above the ranges that can be accurately measured by the diffuse reflection method. In optical profilometry, light is directed to the deposit and scattered therefrom at an angle that is indicative of the height of the deposit. That height is readily calculated by triangulation. The profilometer can be, for example, a confocal profilometer. A confocal profilometer suitable for use in conjunction with the present invention is available from Keyence (Keyence Corp., Japan, or Keyence Corporation of America, Woodcliff Lake, N.J.) as Model LT8105.

Continuing, second robotic transport element 280 picks up a cover layer and, advantageously, an alignment frame from storage station 220 and delivers them to lamination support block 502 (see FIG. 12) at lamination station 260. After measurements are completed at dose measurement station 240, first robotic transport element 270 delivers the substrate with the deposited powder to lamination station 260. First robotic transport element 270 places substrate 8 on cover layer 10 such that the deposits of powder 14 are properly aligned within the perimeter of the bubbles 12 in the cover layer 10 (see FIG. 12).

After first robotic transport element 270 moves away, second robotic transport element 280 returns and, by the operation of bonding head 282, attaches the substrate and cover layer together, forming a plurality of unit forms on a strip (see FIG. 1). In an automated system, the unit forms may be automatically transferred to a packaging station wherein out-of-specification unit forms are screened out and in-spec unit forms are appropriately packaged.

Apparatus 1 for electrostatic deposition provides a product containing a plurality of pharmaceutical or diagnostic unit forms, each comprising at least one pharmaceutically or diagnostic active ingredient that advantageously does not vary from a predetermined target amount by more than about 5%.

The deposition "engine," which comprises deposition station 250 on platform 102 and powder feed apparatus 402, can be a source of a variety of operational problems. Such problems include, for example, powder compaction, non-uniform powder flux, powder loading difficulties, operating instabilities and powder size limitations, among others. While the powder feed apparatus that is disclosed in International Application No. PCT/US99/12772 (and described briefly below) has been designed to avoid many of such problems, room for improvement in that apparatus exists. Such improvement is a goal of the present invention. Before addressing such improvements, which are described later in this Specification in the "Summary" and "Detailed Description" sections, an embodiment of the existing powder feed apparatus is described.

The Deposition Engine

Illustrative powder feed apparatus 402 includes powder-delivery system 403, which charges the powder via a powder-charging system 416 and delivers it to powder distributor 418. The powder distributor delivers the charged powder to deposition station 250 for deposition on the substrate 8 (electrostatic chuck and receiver not shown for clarity of illustration) that abuts gasket 259 framing deposition opening 258. Powder that is not deposited on the substrate is drawn back by a pressure differential through powder-evacuation tubes 426 to powder trap 428. Gas exiting powder trap 428 is delivered to HEPA filter 430.

In the illustrated embodiment, powder-delivery system 403 comprises auger rotation motor 404, hopper 406, vibrator 408, auger 410, clean gas source 414 feeding modified venturi feeder valve 412, and powder-charging system 416, interrelated as shown. In some embodiments, feeder valve 412 feeds powder-charging system 416. With the exception of powder-charging system 416, illustrative powder delivery system 403 is disposed substantially within enclosure 432, which is depicted in phantom for clarity of illustration.

In the illustrated embodiment, the powder-charging system is realized as a tube, referred to hereinafter as powder-charging feed tube 416. It will be understood, however, that in other embodiments, arrangements for powder charging other than the illustrated tube may suitably be used.

In place of venturi 412, a gas source can be provided to propel powder through powder charging feed tube 416. In one embodiment, gas source 414 directs gas pressure towards the outlet of a mechanical device that feeds powder. The gas jet can be directed and adjusted to act to de-agglomerate powder at that outlet.

In an alternate embodiment (not depicted), the hopper and auger arrangement depicted in FIG. 13 can be replaced with a rotating drum that temporarily stores powder and delivers it to a movable belt. The movable belt then transports the powder to a means for removing the powder from the belt. An example of such a means is a thin, high velocity jet of gas that blows the powder into powder charging feed tube 416 or a conduit in communication therewith.

For electrostatic deposition, the powder must be charged. This function is accomplished, as described above, by the powder-charging system (e.g., powder-charging feed tube 416). Some further details concerning powder charging is now provided.

In one embodiment, powder charging feed tube 416 is made of a material that imparts, by triboelectric charging, the appropriate charge to the powder as it transits the tube making periodic collisions with the sides thereof. As is known in the art, TEFLON®, a perfluorinated polymer, can be used to impart a positive charge to the powder (where appropriate for the powder material) and Nylon (amide-based polymer) can be used to impart a negative charge.

In so charging the powder, the tube builds up charge which can, if not accommodated, discharge by arcing. Accordingly, a conductive wrap or coating is applied to the exterior of powder charging feed tube 416 and grounded. Tube 416 can be wrapped, for example, with aluminum or copper foil, or coated with a colloidal graphite product such as Aquadag®, available from Acheson Colloids Co. of Port Huron, Mich. Alternatively, powder charging feed tube 416 can be coated with a composition comprising graphite or another conductive particle such as copper or aluminum, an adhesive polymer, and a carrier solvent, mixed in amounts that suitably preserves the "tackiness" of the adhesive polymer. An example of such a composition is 246 g trichloroethylene, 30 g polyisobutylene and 22.5 g of graphite powder.

The charge relieved by the grounding procedures outlined above can be monitored to provide a measure of powder flux through powder charging feed tube 416. This data is advantageously sent to processor P for analysis. As a result of such analysis, deposition operating parameters can be modified, as appropriate, to maintain an on-specification operation.

Another way to impart charge to the powder is by "induction" charging. One way to implement induction charging is to incorporate an induction-charging region in powder charging feed tube 416. More particularly, at least a portion of powder charging feed tube 416 comprises a material such as a stainless steel, which is biased by one pole from a power supply, with the opposite pole grounded. With an appropriate bias, an electric field is created in the induction-charging region such that powder passing through it picks up a charge. The length of the induction-charging region can be adjusted as required to impart the desired amount of charge to the powder. In one embodiment, induction charging is used in conjunction with the tribocharging features described above.

In yet another embodiment, powder is charged by "corona charging," familiar to those skilled in the art. See, for example, J. A. Cross, "Electrostatics: Principles, Problems and Applications," IOP Publishing Limited (1987), pp. 46–49.

As previously indicated, powder charging feed tube 416 feeds charged powder via powder distributor 418 into deposition station 250, which is enclosed by enclosure 252. In the illustrated embodiment, powder distributor 418 comprises rotating baffle 424 that depends from nozzle 422. Nozzle motor 420 drives the rotating baffle.

Powder moving towards substrate 8 passes through control grid 254. Control grid 254 is advantageously disposed a distance of about one-half to about 1.0 inch below collection zones CZ of the electrostatic chuck (not shown in FIG. 12), and is biased at about 500 V per one-half inch of such distance at the polarity intended for the powder. Control grid 254 thus "collimates" the powder cloud thereby attracting powder having an opposite charge (to the charge on the control grid).

Control grid 254 can be, for example, a series of parallel electrical wires, such as can be formed from "switchbacks" of one wire, or, alternatively, a grid of wires. Spacing between parallel sections of wire is advantageously within the range of about 5 to about 15 mm. The rate of powder cloud flux can be monitored by measuring light attenuation between light emitter 256 (e.g., a laser emitter) and light detector 257. This value can be transmitted to processor P.

It has been found that fluctuations occur in the gas/powder flow through the deposition engine described above. Such fluctuations negatively impact deposition performance. The fluctuations are due, at least in part, to:

(1) the non-axisymmetric geometry of some embodiments of rotating baffle 424 and deposition station 250;

(2) the pulsing manner in which powder is delivered by some embodiments of powder delivery system 403; and (3) flow instabilities due to boundary layer separation and vortex shedding.

It will be appreciated that it is desirable to reduce such gas/powder flow fluctuations to improve the performance of the deposition apparatus.

SUMMARY OF THE INVENTION

In accordance with the illustrative embodiment of the present invention, flow fluctuations observed in the existing deposition apparatus are reduced using a flow diffuser. The flow diffuser, which replaces the powder distributor of the existing deposition apparatus, comprises a conduit having a cross-sectional area that increases in the direction of powder flow. The increase in cross section controllably slows the gas flow to a velocity wherein electrostatic forces dominate the motion of the powder transported via the gas.

In some embodiments, the diffuser includes one or more flow control features. A first flow-control feature comprises one or more appropriately-shaped annular slits through which gas is injected into a "boundary layer" near the wall of the diffuser. The injected gas has a greater momentum than the gas in the boundary layer. Such injected gas serves several purposes, as itemized below.

1. Reducing the tendency for boundary-layer separation.
2. Directing/shaping the "powder cloud" (ie., the powder-transporting gas) towards a central axis of the diffuser. Such shaping counteracts an existing tendency for charged particles to repel one another, which tendency would otherwise cause the powder to migrate away from the central axis of the diffuser.
3. Providing a "gas-curtain" effect that reduces the tendency for powder contained in the powder cloud to get stuck against the diffuser wall.

A second flow control feature comprises one or more annular slits, or a multiplicity of slots/holes that are disposed at appropriate locations around the circumference of the diffuser. Such openings are in fluid communication with a pressure-differential generating means. The pressure-differential generating means generates a pressure differential across the openings in the diffuser such that pressure on the exterior of the diffuser is less than the pressure in the interior of the diffuser. As such, a portion of the powder-transporting gas in the slow-moving boundary layer is removed. Removing such slower-moving gas contributes to a flattening of the velocity profile of the powder-laden gas in the diffuser. And, such velocity-profile flattening tends to stabilize the powder-laden gas flow by preventing flow separation or at least delaying its onset.

Thus, the diffuser, the flow control features, and other elements related to powder delivery to the deposition station advantageously reduce spatial and temporal variations in the velocity of the powder-laden gas. The resulting increase in the uniformity of the flow-field improves control over the deposition operation. Such improved control results in an improvement in the uniformity and precision (i.e., the variation in the amount of active ingredient from a target amount) of depositions.

DETAILED DESCRIPTION OF THE INVENTION

In this Detailed Description, reference is made to well-understood fluid dynamics concepts, including, for example, "boundary layer" and "flow separation" theory. Since such concepts are well-known to those skilled in the art, they will not be defined or discussed herein.

Figure 1:
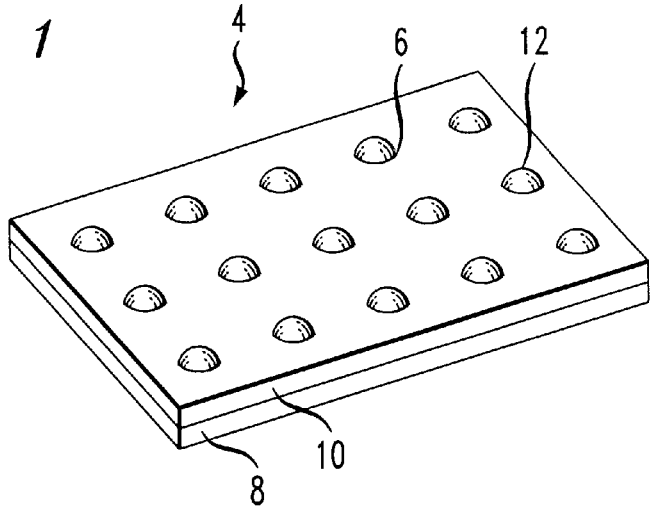
FIG. 1 depicts an isometric view of a strip containing a plurality of unit forms.
Figure 2:
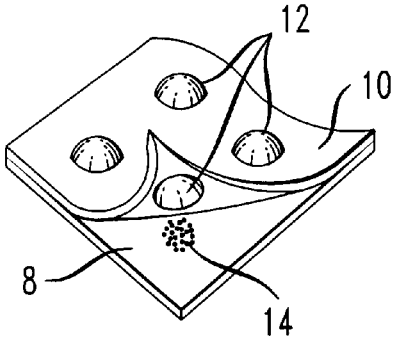
FIG. 2 depicts a cover layer of a strip package partially separated from a substrate.
Figure 3:
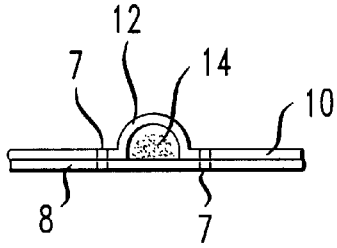
FIG. 3 depicts a side view of an illustrative unit form.
Figure 4:
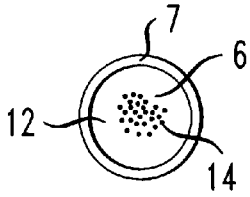
FIG. 4 depicts a top view of the illustrative unit form of FIG. 3.
Figure 5:
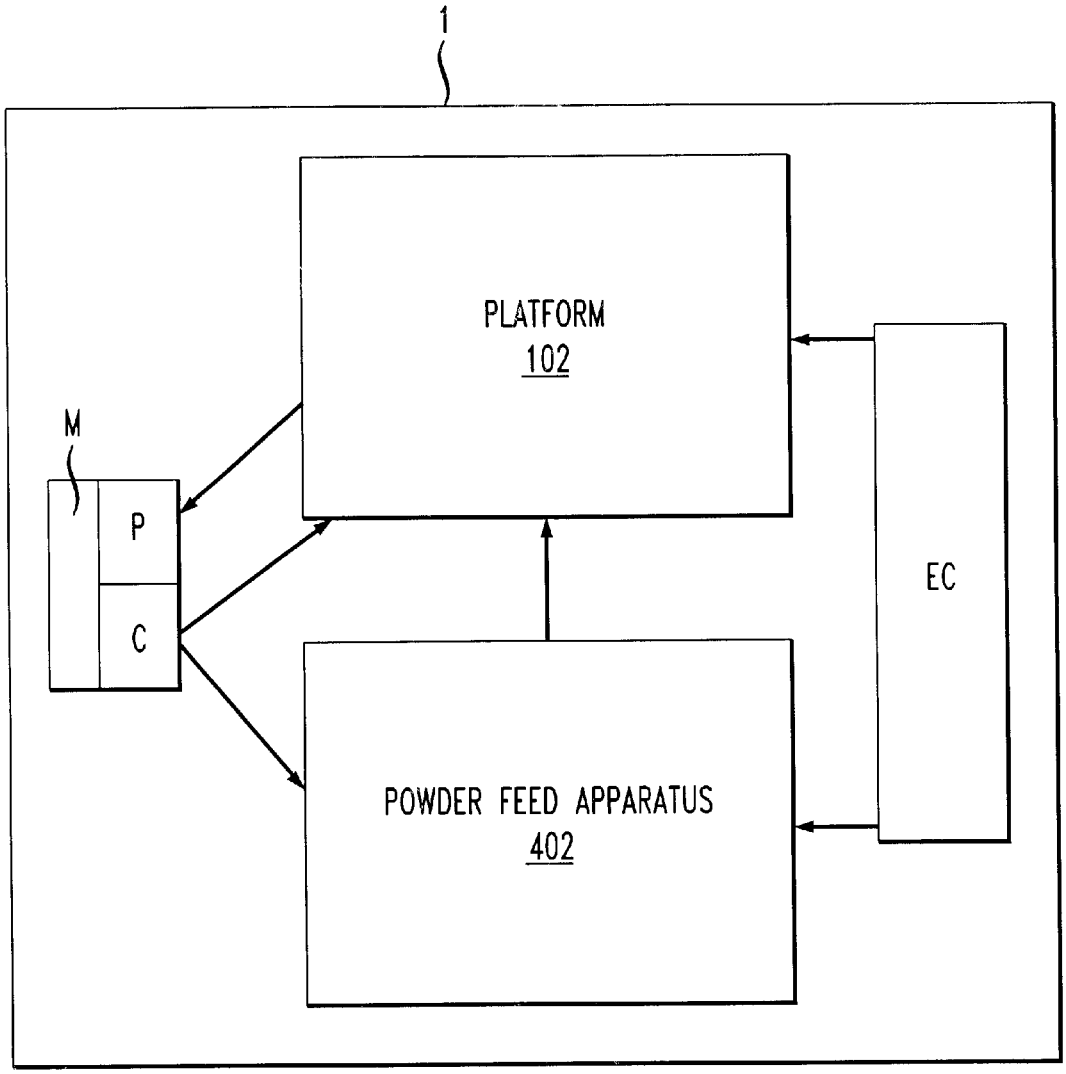
FIG. 5 depicts a high-level block diagram of an apparatus suitable for producing the unit forms of FIGS. 1–4.
Figure 6:
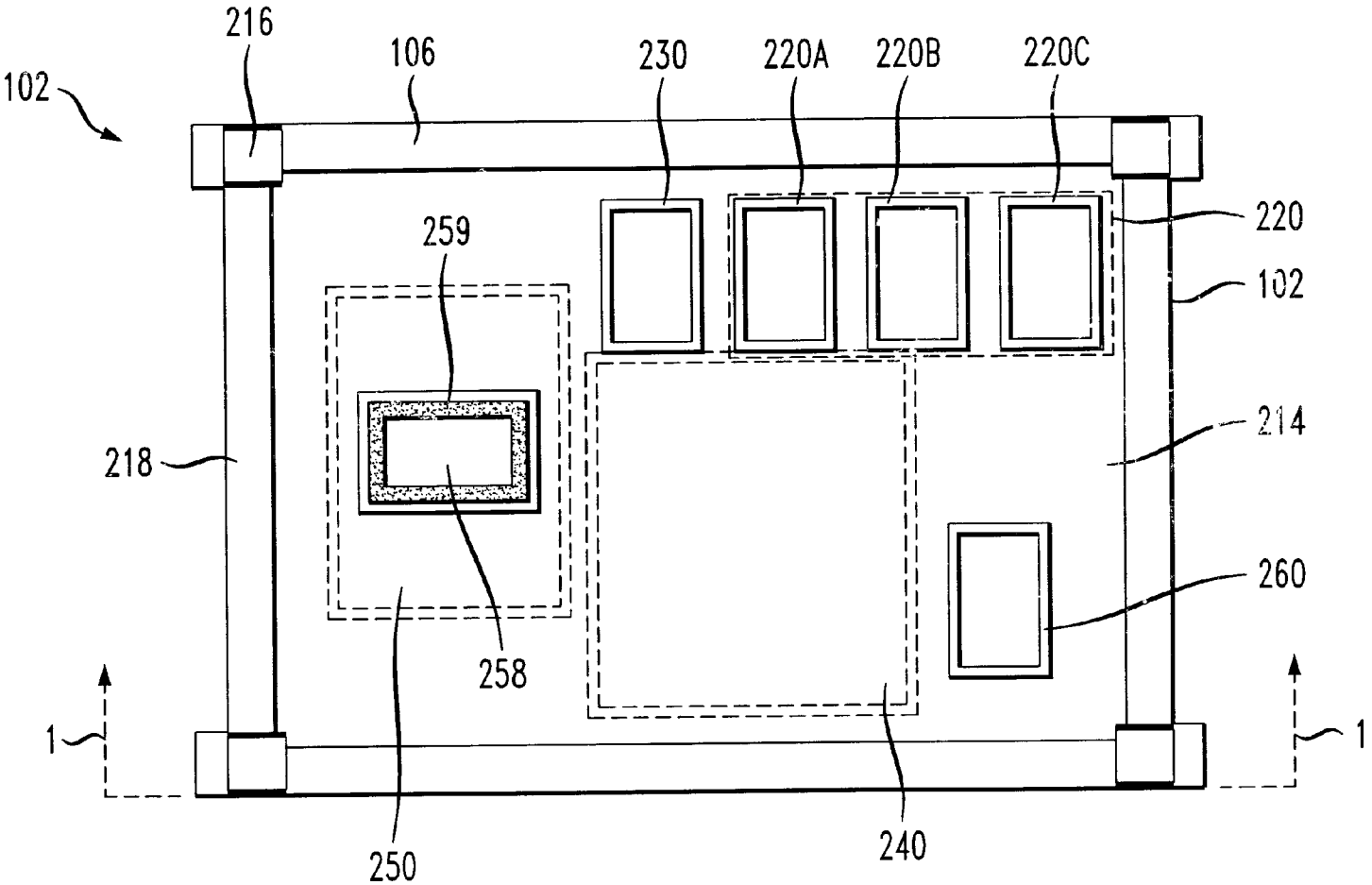
FIG. 6 depicts a top view of a platform wherein processing operations occur.
Figure 7:
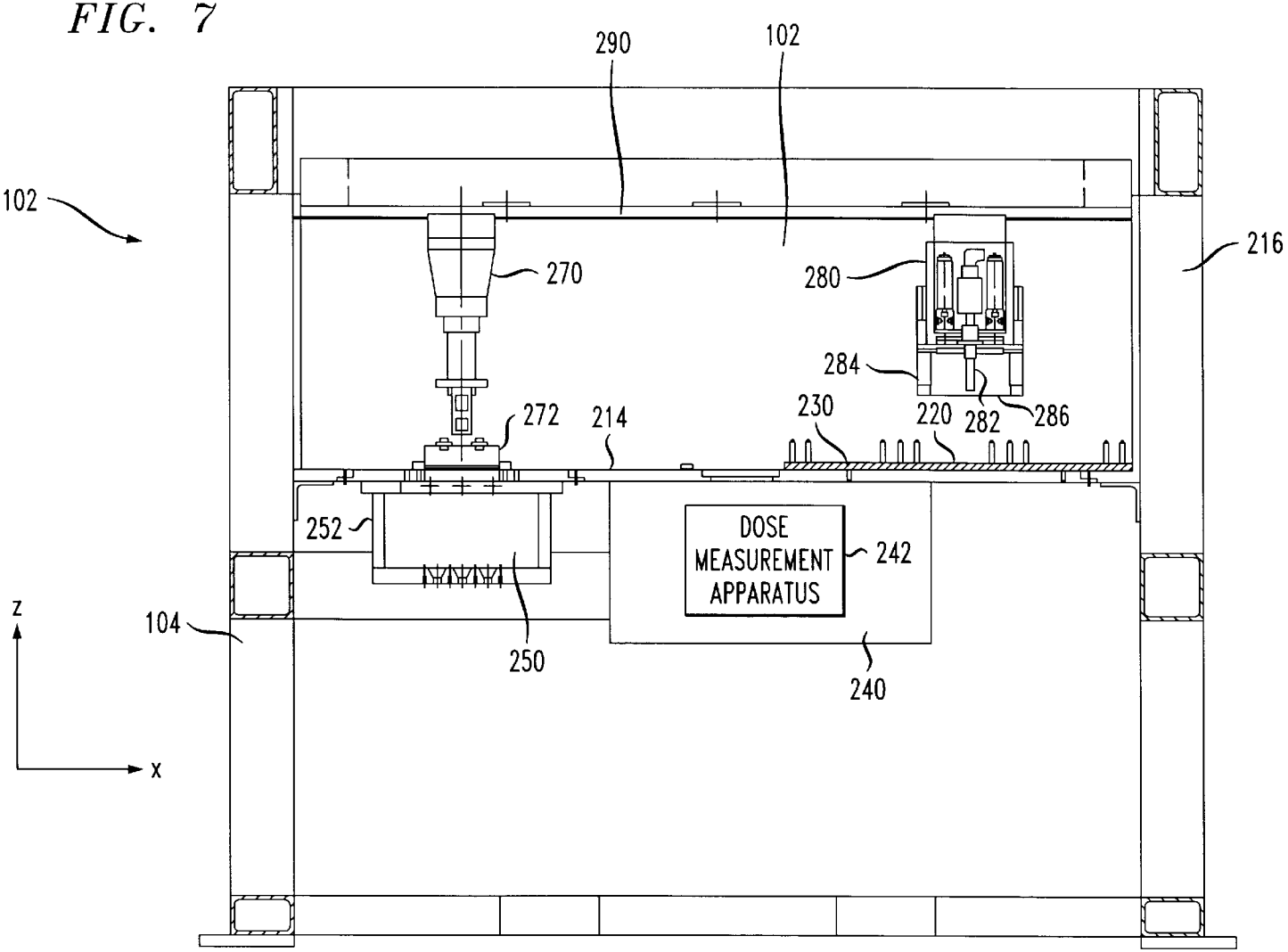
FIG. 7 depicts a side elevation of the platform of FIG. 7.
Figure 8:
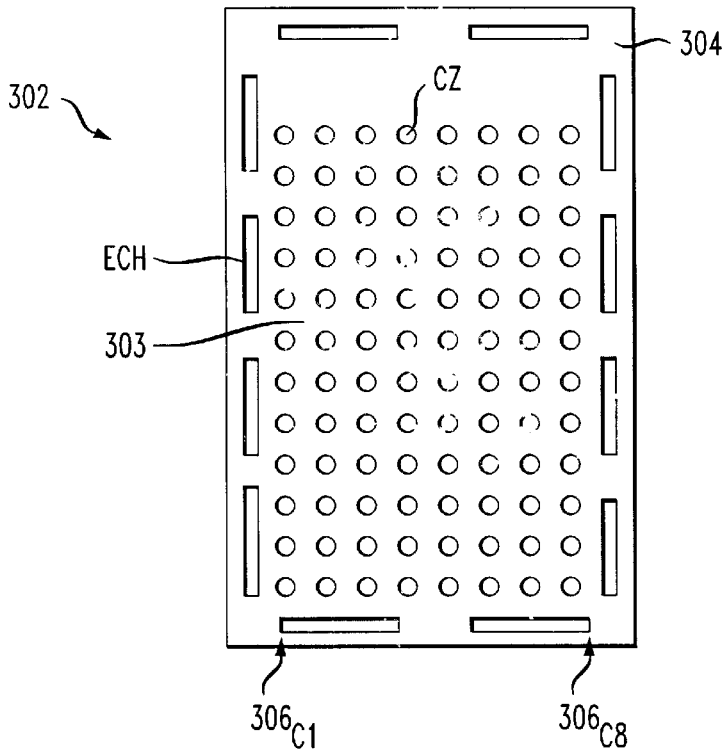
FIG. 8 depicts a plan view of a first surface of an illustrative electrostatic chuck.
Figure 9:
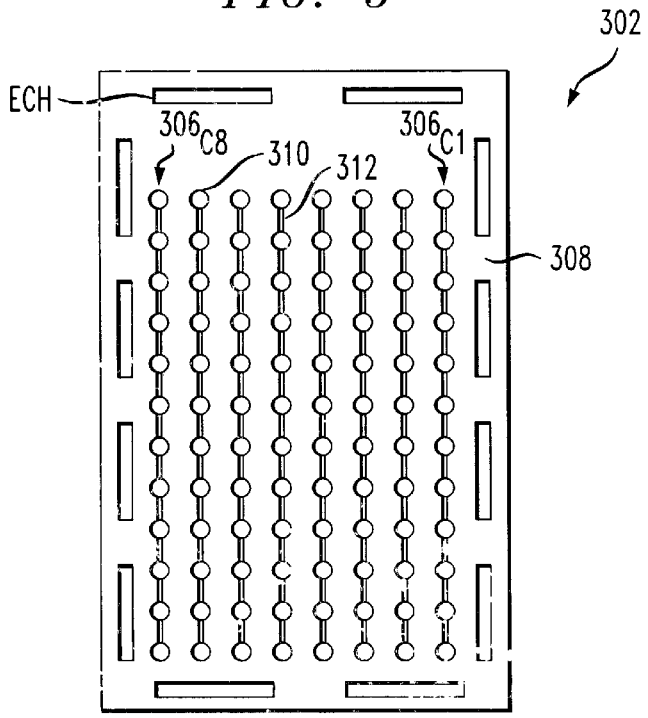
FIG. 9 depicts a plan view of a second surface of an illustrative electrostatic chuck.
Figure 10A:
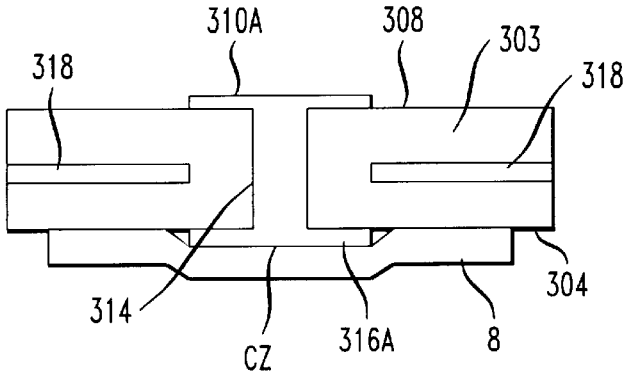
FIGS. 10*a*–10*c* depict side cross-sectional views of embodiments of the electrostatic chuck of FIGS. 8 and 9 near a collection zone.
Figure 10B:
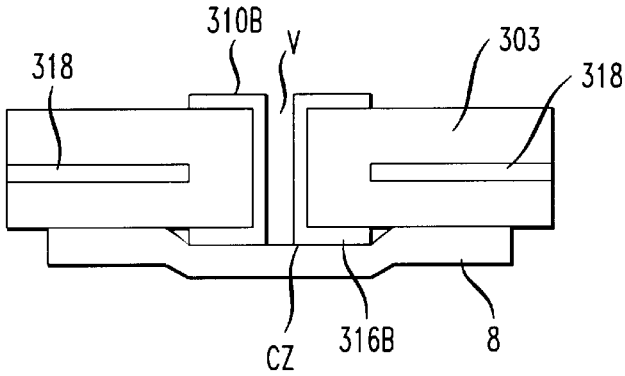
Figure 10C:
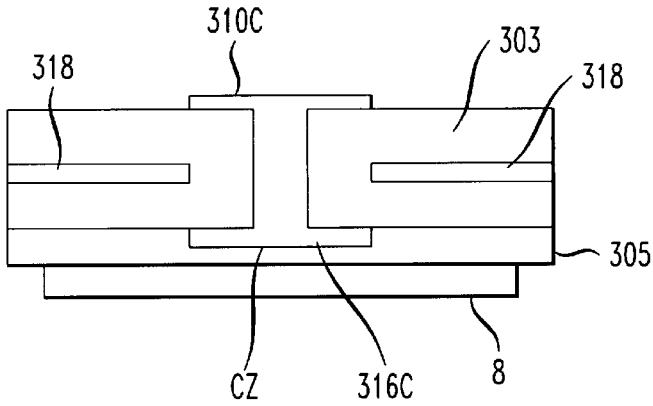
Figure 11:
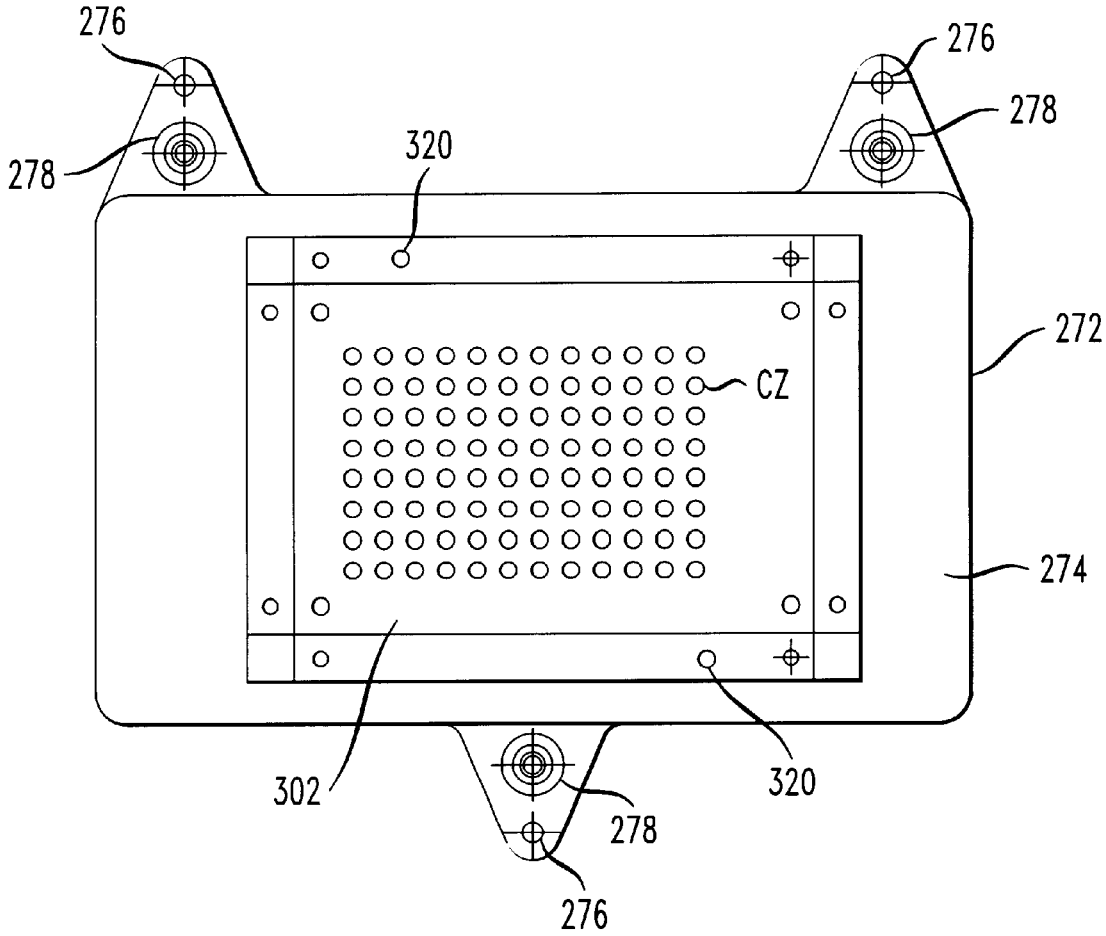
FIG. 11 depicts the underside of the illustrative receiver with the electrostatic chuck adhered thereto.
Figure 12:
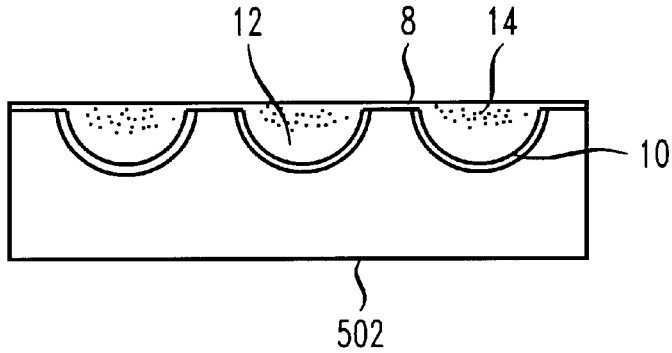
FIG. 12 depicts a lamination support block for laminating the substrate and cover layer together.
Figure 13:
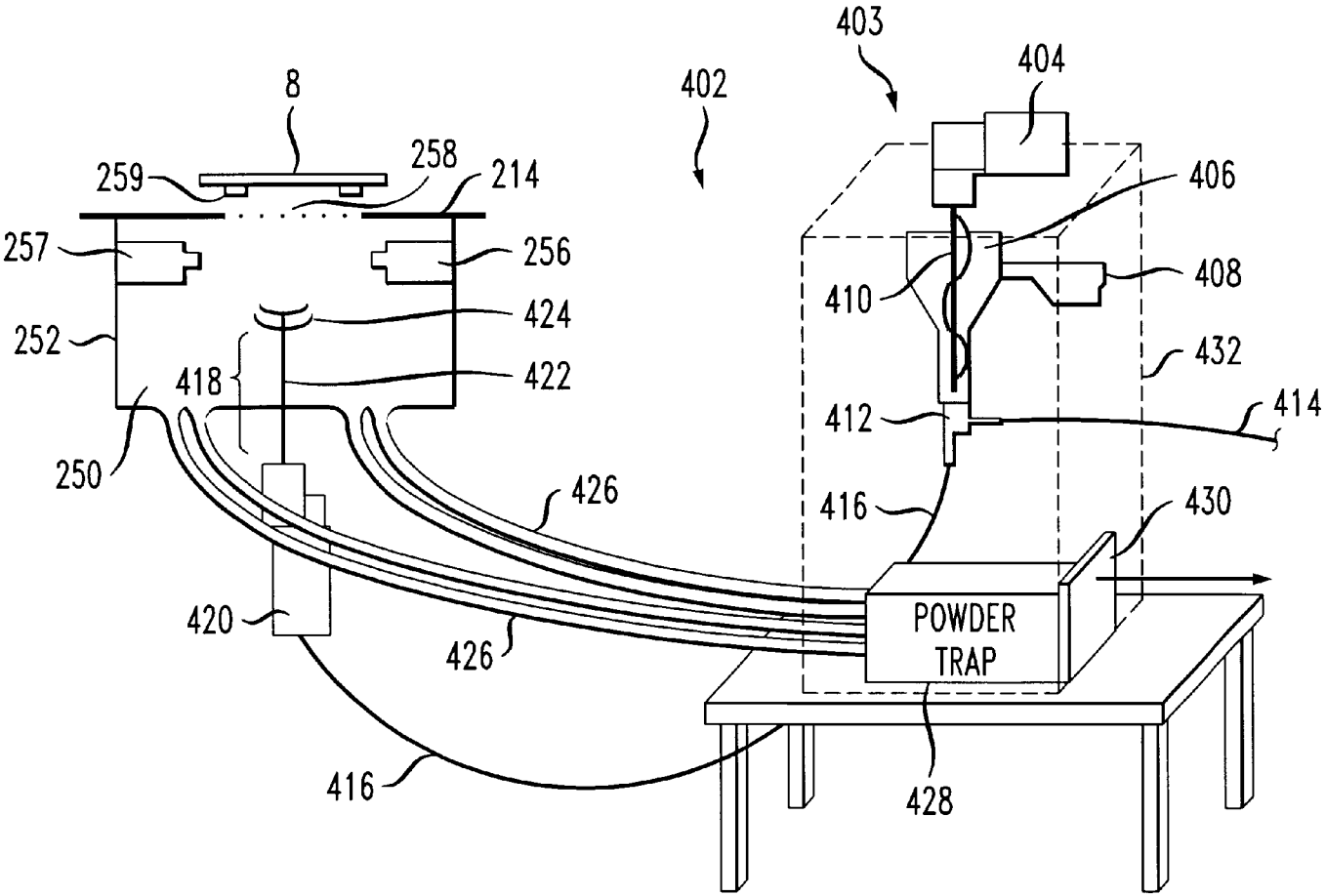
FIG. 13 depicts a deposition engine for electrostatically depositing powder on a substrate.
Figure 14:
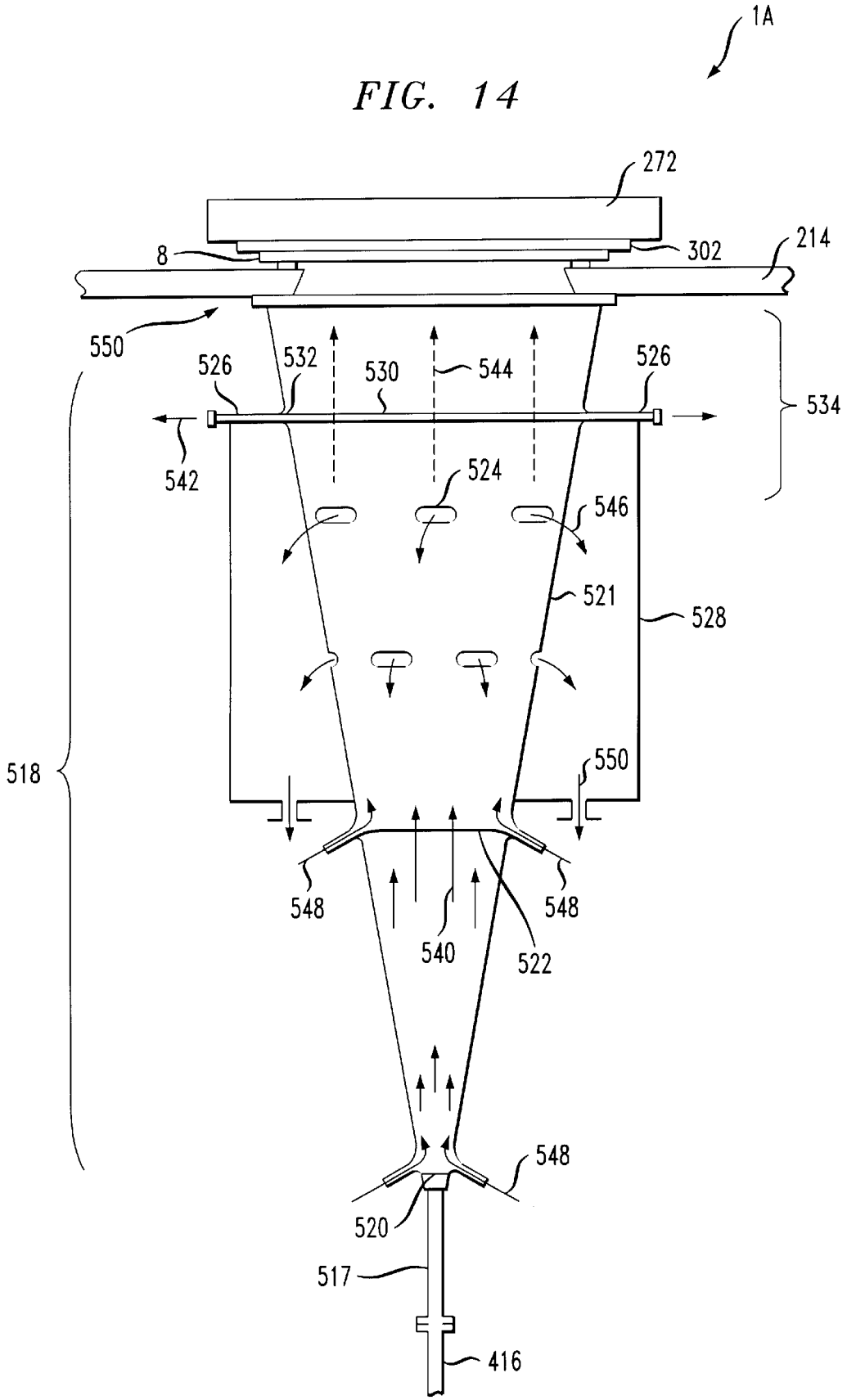
FIG. 14 depicts a portion of an improved deposition apparatus in accordance with the present teachings, the depicted portion including a diffuser.

FIG. 14 depicts a portion of deposition apparatus 1A in accordance with the present teachings. The portion of apparatus 1A depicted in FIG. 14 includes a region of powder-charging feed tube 416, flow straightener 517, diff-user 518, and deposition station 550. FIG. 14 also shows substrate 8, electrostatic chuck 302 and receiver 272 all engaged to deposition station 550.

Powder-laden gas leaves powder-charging feed tube 416 and enters flow straightener 517, wherein turbulence in the powder-laden gas is reduced. As described in further detail later in this Specification, the flow straightener can be used to tailor the flow profile within the diffuser. From the flow straightener 517, the powder-laden gas enters diffuser 518. The cross-sectional area of diffuser 518 increases in the direction of flow. As such, average fluid velocity decreases as the powder-laden gas 540 moves through diffuser 518. As the powder-laden gas flows through the diffuser, it eventually encounters a region wherein the gas velocity slows to the extent that electrostatic forces generated by the space-charge of the powder, electrostatic chuck 302 and optional focusing electrode (see FIGS. 16 and 17) dominate the motion of the powder. This region is referred to herein as "particle drift zone 534." The specific location of particle drift zone 534 is dictated by flow parameters and electrostatic-field strength. By way of illustration, in some embodiments, the particle drift zone may occupy as much or more than the latter one-half of the diffuser.

Diffuser 518 is formed from a material that is compatible with the deposition process being used. For example, in the illustrated embodiments, the diffuser is used in conjunction with an electrostatic deposition process. As such, the interior surface of wall 521 of diffuser 518 must be capable of accepting an electrical charge and maintaining it. Moreover, the material must be compatible with the charging characteristic of the powder and the charging method (e.g., if the powder is positively charged, the material comprising wall 521 must not change the positive charge to a negative charge). Furthermore, to the extent that the diffuser is used in conjunction with a process that is producing pharmaceuticals, the material must satisfy pertinent FDA regulations.

As will be apparent to those skilled in the art, when the present diffuser is used in conjunction with an electrostatic deposition process, the diff-user should be formed from a dielectric material, such as any one of a variety of plastics, including, without limitation, acrylic and polycarbonate plastics. To the extent that the present diffuser is used in conjunction with other types of powder deposition processes, or more generally, in other types of powder-delivery systems, other materials requirements may be controlling.

Charged powder 544 is moved through the diffuser under the control of aerodynamic forces of the flowing fluid until it enters particle drift zone 534. In the particle drift zone, electrostatic forces control powder movement, since, in this region of the diffuser, such forces dominate aerodynamic forces. In other words, in particle drift zone 534, the powder does not follow the flow streamlines of the gas.

Gas 542, substantially sans powder, is withdrawn from diffuser 518 at annular slit 530. The gas is ultimately withdrawn via several circumferentially-located outlets 526. The annular slit 530 is advantageously well rounded, as depicted at region 532, to avoid introducing turbulence into the uniform flow profile established by diffuser 518. Powder 544 is deposited on substrate 8 at regions overlying the collection zones (not shown) of electrostatic chuck 302.

In some embodiments, one or more flow-control features are advantageously used in conjunction with diffuser 518. A first flow control feature is the injection of gas 548 into the "boundary layer" flow within the diffuser. The injected gas, which can be, for example, nitrogen, should have a greater momentum than the powder-laden gas flowing in the boundary layer (such momentum calculations are readily performed by those skilled in the art). The injected gas is introduced through a boundary-layer gas injector, which comprises one or more annular slits in diffuser 518. In the embodiment depicted in FIG. 14, gas is injected into the boundary-layer at two locations: a first injection slit 520 disposed near the inlet of diffuser 518 and a second injection slit 522 disposed near the mid-point of the diffuser.

The boundary-layer injection gas is injected into the diffuser in the form of a thin stream, and is "directed" to flow along wall 521. In one embodiment, the gas is directed toward wall 521 by having the injection slits (e.g., 520 and 522) inject the gas towards wall 521. In a second embodiment, the injection slit is substantially perpendicular to wall 521 of the diffuser (ie., nominally directing injected gas away from nearby wall 521 and towards the central flow region). In the second embodiment, the "upstream" wall of the slit (i.e., the slit wall nearest the diffuser inlet) is provided with a sharp edge, and the "downstream" wall of the slit is provided with a well-rounded edge. As a result of this arrangement, the injected gas turns the rounded edge to remain near wall 521. This effect, known as the Coanda effect, is known to those skilled in the art.

The boundary-layer gas injection improves flow uniformity. In particular, such injection reduces or prevents flow separation at the interior surface of wall 521 of diffuser 518. Moreover, gas injection effects a "shaping" or "steering" of powder-laden gas 540 toward central axis 519 (see FIG. 15) of diffuser 518. Such steering counteracts the tendency of the charged particles to move away from the central axis due to the mutual repulsion of such similarly-charged particles. Additionally, such gas injection provides a "gas curtain" effect, wherein powder contained in the gas 540 is kept away from the interior surface of diffuser wall 521, thereby reducing the tendency for powder to accumulate thereon.

Figure 15:
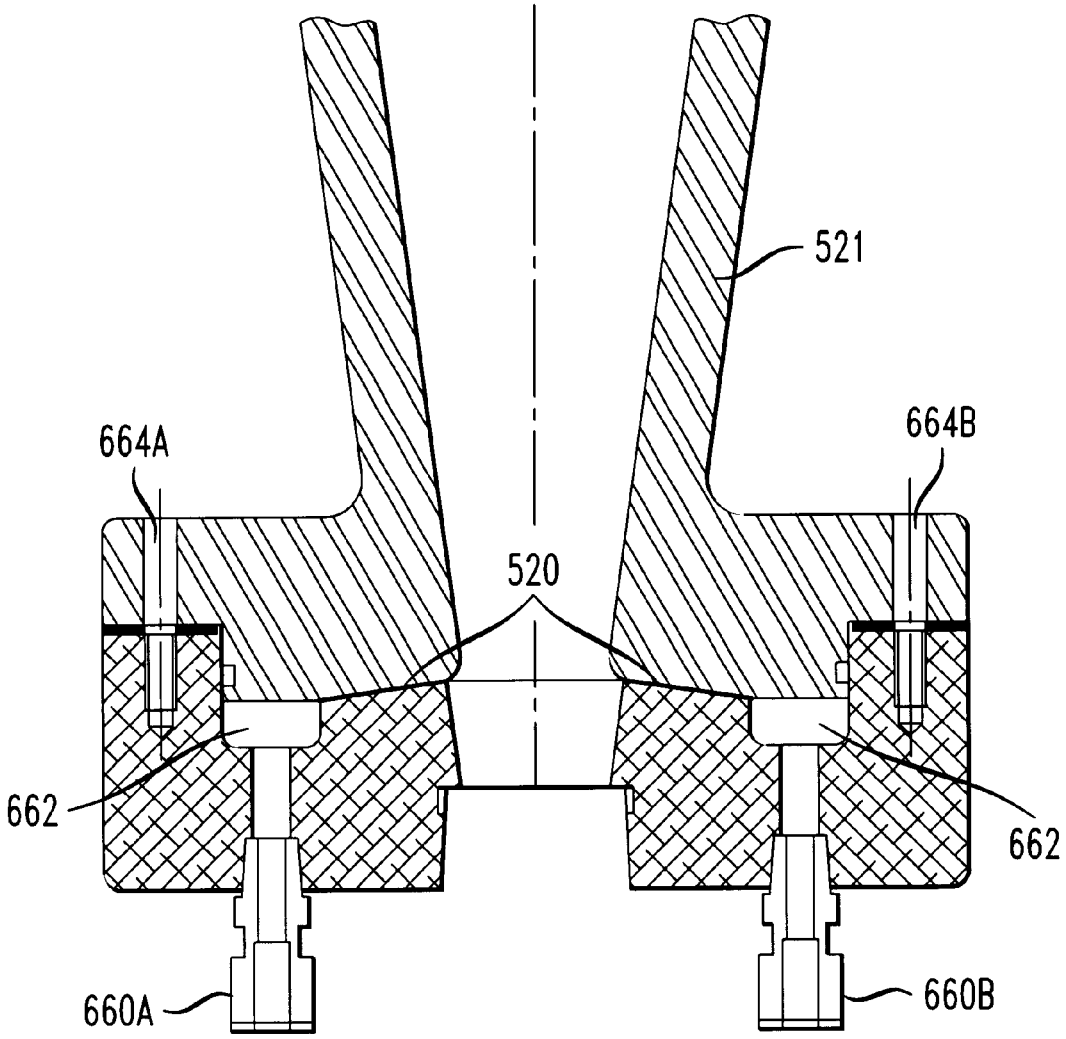
FIG. 15 depicts an illustrative boundary-layer gas injector.

Further embodiments of illustrative boundary-layer gas injectors are described in conjunction with FIGS. 15–19. FIG. 15 depicts an "enlargement" of the region near injection slit 520 of diffuser 518 depicted in FIG. 14. In the embodiment depicted in FIG. 15, the boundary-layer gas injector further comprises two nozzles 660A and 660B, annular channel 662, and fasteners (received by bores 664A and). The gas that is to be injected into the boundary layer is delivered to annular channel 662 from nozzles 660A and 660B. Fasteners, such as screws or the like (not shown),that are received by bores 664A and 664B control the size of slit 520. In particular, tightening one of the fasteners (e.g., the fastener in bore 664A) more than the other fastener (e.g., the fastener in bore 664B) causes the slit to be slightly larger at one region (e.g., near bore 664B) than at another region (e.g., near bore 664A).

When the flow rate of injection gas into nozzles 660A and 660B is equal, the flow of injection gas through injection slit 520 will be relatively greater at a region at which the injection slit is relatively larger. It has been found that such a variation in the boundary layer gas injection will affect flow distribution near the outlet of diffuser 518 and can ultimately affect the powder distribution on substrate 8.

Figure 16:
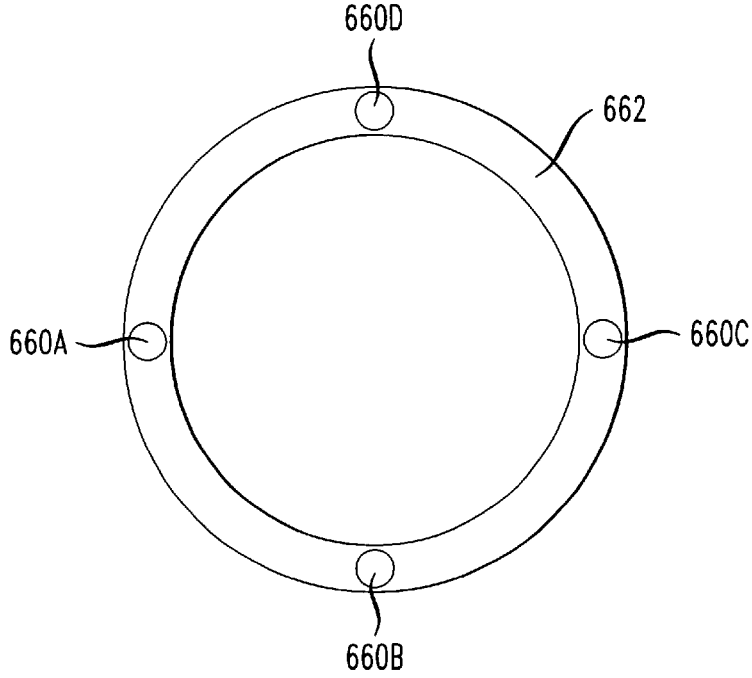
FIG. 16 depicts a top cross-sectional view of a first illustrative embodiment of an annular channel in a boundary-layer gas injector and four injection nozzles.

In a further embodiment of a diffuser in accordance with the present teachings, boundary layer gas injection is regionally varied by introducing additional injection nozzles, as is depicted in FIG. 16. FIG. 16 depicts a top-cross sectional view of the annular channel 662. As shown in FIG. 16, four nozzles 660A–660D deliver injection gas to annular channel 662. By individually varying the flow of injection gas through nozzles 660A–660D, the flow distribution near the outlet of diffuser 518 can be affected (e.g., a greater amount of powder can be directed to a particular region of the substrate). While four nozzles are depicted in FIG. 16, a greater number of nozzles can be used, thereby providing an even greater measure of control over the downstream powder distribution.

Figure 17:
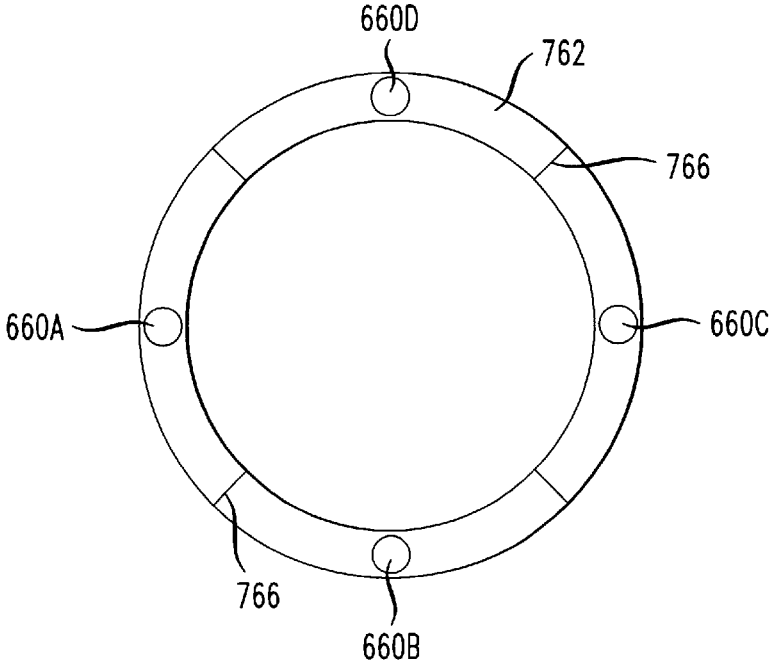
FIG. 17 depicts a top cross-sectional view of a second illustrative embodiment of an annular channel in a boundary-layer gas injector and four injection nozzles.

FIG. 17 depicts yet a further embodiment wherein annular channel 762 is segmented into regions via dividers 766. The flow of injection gas within a particular region of the channel is thus dictated via the nozzle feeding that region. Such an arrangement is expected to provide a greater measure of control over downstream powder distribution than continuous annular channel 662 depicted in FIG. 16.

As described earlier in this Specification, "charge" sensors (which actually measure current) disposed on or near electrostatic chuck 302 can be used to determine the amount of powder being deposited on a regional basis on the substrate. In some embodiments, sensors are provided at each collection zone CZ such that the powder distribution is known at each point across substrate 8. Such information can be used as the basis for a closed-loop control system (feedback or feedforward) wherein the boundary-layer gas injection flow is adjusted to correct any deviations in the powder distribution.

Figure 18:
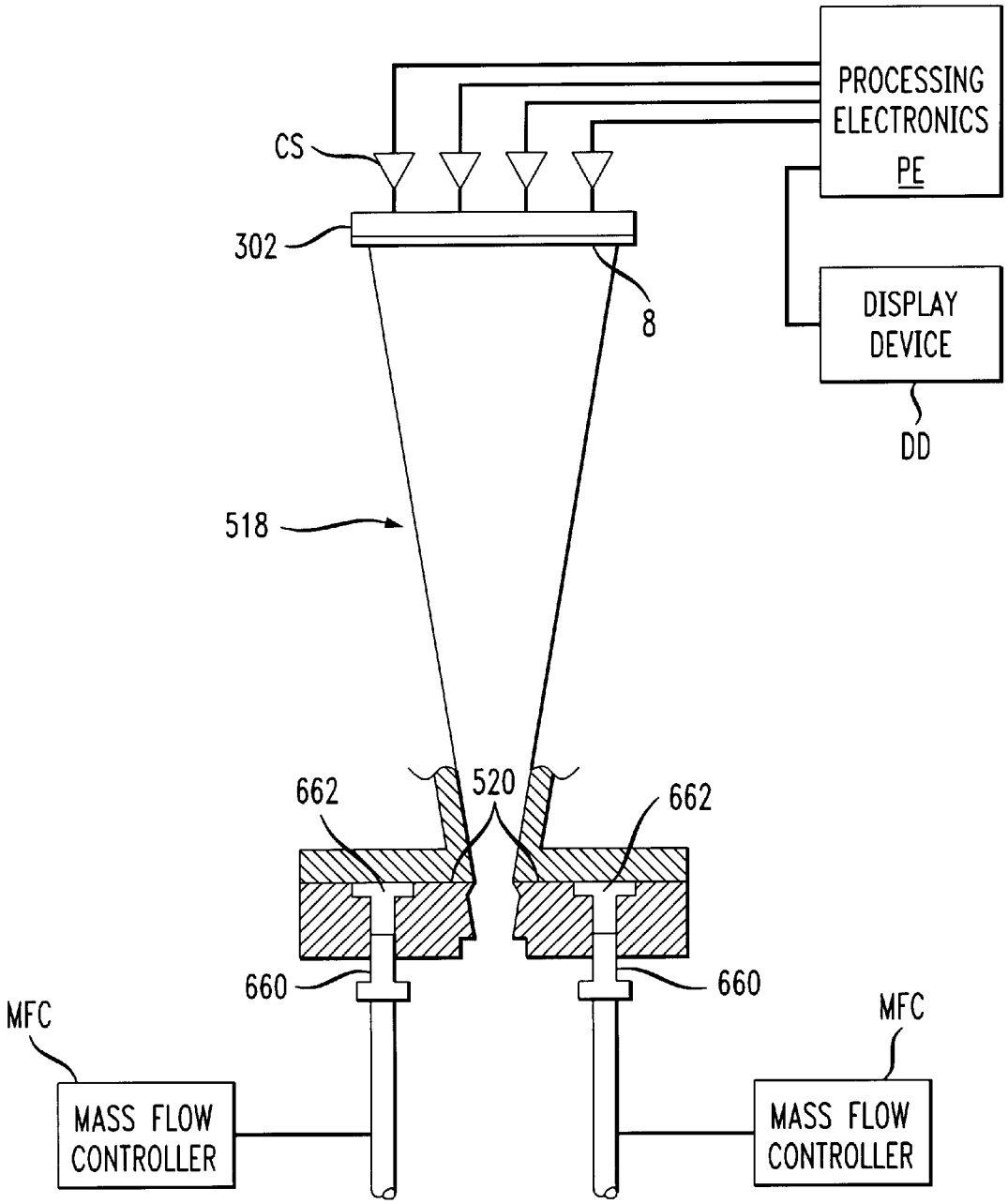
FIG. 18 depicts an illustrative embodiment of a manual control system for adjusting boundary-layer gas injection responsive to the powder deposition data.

FIG. 18 depicts a manual control scheme wherein the output from the charge sensors CS is delivered to processing electronics PE, and an indication of the powder distribution is provided to an operator (e.g., displayed on a display device DD). The operator can then manually adjust the boundary-layer gas injection via flow-control means, such as mass-flow controllers MFC, that individually control the flow of injection gas through each nozzle 660.

Figure 19:
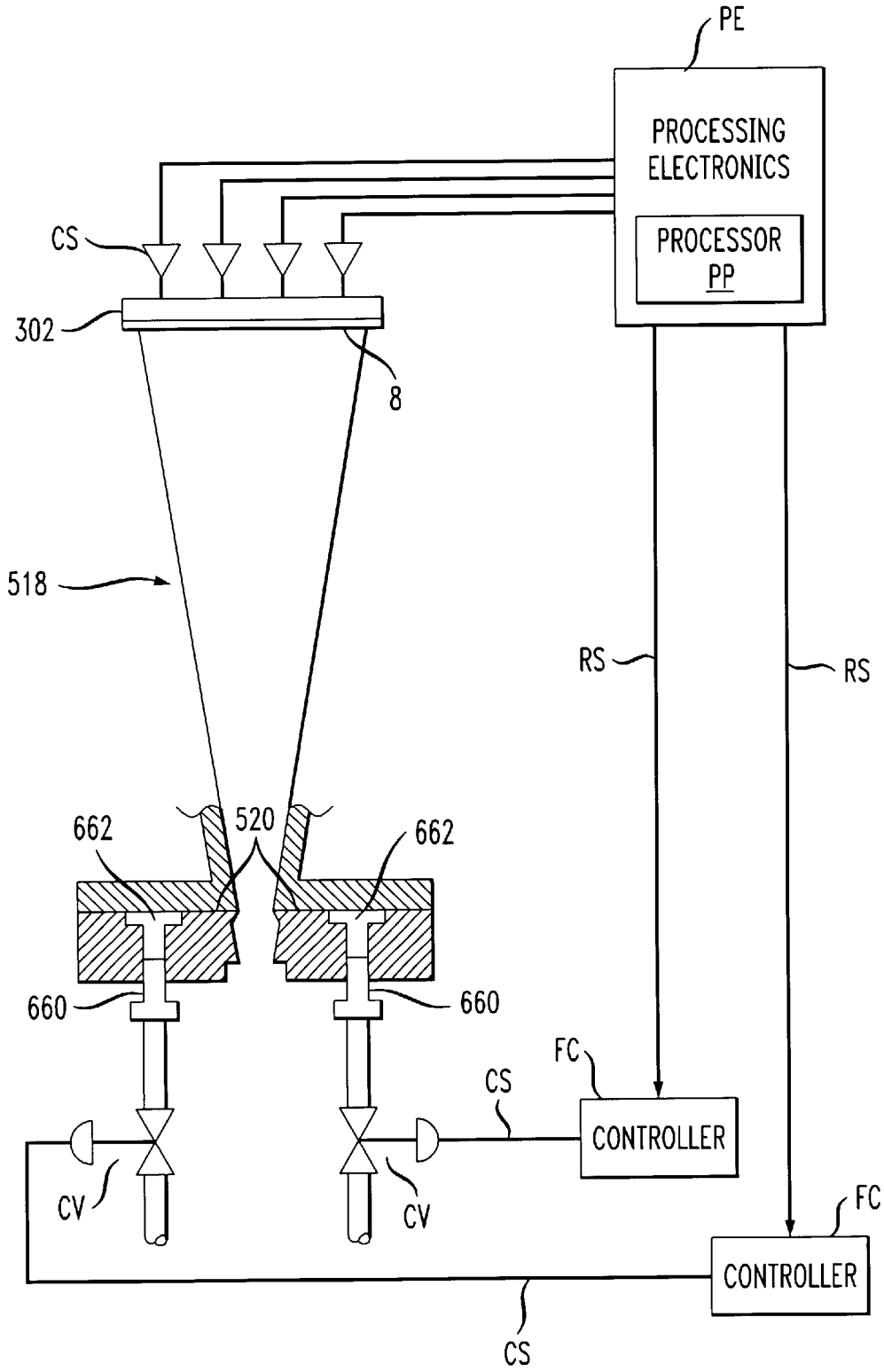
FIG. 19 depicts an illustrative embodiment of an automatic control system for adjusting boundary-layer gas injection responsive to the powder deposition data.

FIG. 19 depicts an automatic control loop wherein the output of the charge sensors CS is delivered to appropriate processing electronics PE including a suitably-programmed processor PP that determines how the boundary layer flow should be adjusted to correct deficiencies in the powder distribution. One or more signals RS are generated that reset the set-point of a controller FC that controls the operation of a flow-control valve CV feeding each nozzle 660. Controllers FC generate a control signal CS that causes the controlled valve to incrementally open or close thereby increasing or decreasing flow therethrough.

A second flow control feature that is used in conjunction with some embodiments of the present diffuser comprises a "boundary layer" gas suction, wherein gas is withdrawn from the slowly-moving boundary layer (not depicted) adjacent interior surface of wall 521 through a boundary-layer gas aspirator. The boundary-layer gas aspirator comprises one or more openings in wall 521 for withdrawing gas 546, and a pressure-differential-generating means that creates a pressure differential across such openings to draw gas 546 therethrough. In the embodiment depicted in FIG. 14, the boundary-layer gas aspirator comprises multiple rows of slots 524 disposed in wall 521. As depicted in FIG. 14, slots 524 are advantageously offset, on a row-by-row basis, from slots 524 in an adjacent row. In other embodiments, an annular slit configured in the manner of injection slits 520 and 522 can be used for the boundary layer gas suction.

In the illustrated embodiment, the pressure-differential-generating means includes a pressure-tight shell/enclosure 528 and a suction flow generating means (not shown) that is in fluid communication with shell 528. The suction flow generating means creates a flow 550 out of said enclosure 528. Flow 550 establishes the pressure differential across holes 524 that withdraws gas 546 from the boundary layer. Flow 550 can be generated in a variety of well-known ways, such as, for example, by using a piston or diaphragm-type vacuum pump or a jet ejector.

In some embodiments of the present invention, "vanes" (not shown) are disposed within the diffuser. In one of such embodiments, the vanes are arranged radially about central longitudinal axis 519. In another of such embodiments, the vanes are configured as a multiplicity of concentric rings that are centered about longitudinal axis 519. The vanes flatten the velocity profile of powder-laden gas 540, forestalling flow separation. Such vanes may, however, have a tendency to collect powder from powder-laden gas 540.

It should be understood that the aforementioned flow-control features (i.e., boundary-layer gas injection, boundary-layer gas suction and vanes) are used individually in some embodiments, and in various combinations in other embodiments.

Figure 20:
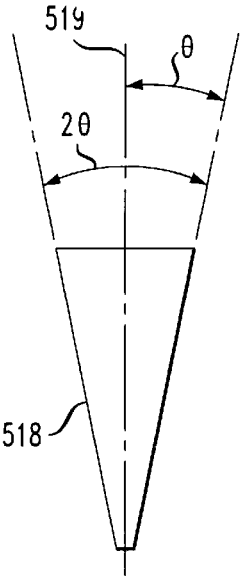
FIG. 20 depicts a characteristic angle used to describe the diffuser configuration.

The "cone angle" of the diffuser, which is expressed as $2\theta$ (see FIG. 20), affects diffuser performance. While well-known equations express relationships between cone angle and performance parameters, suitable cone angles for the diffuser are best determined by fabricating sample diffusers and then evaluating their performance.

The flow-control features described herein facilitate use of greater cone angles, which results in relatively "shorter" diffusers. A cone angle of about 15° has been found to be suitable for a diffuser that does not rely on the additional flow-control features described above. More generally, it is expected that a cone angle within the range of about 10° to about 17° is suitable for such an application. Use of such flow- control features, and ensuring smooth, well rounded surfaces in transition regions (e.g., axial slits, boundary between flow straightener and diffuser, etc.) allows for a significantly greater cone angle. Specifically, in such circumstances, it is expected that satisfactory performance can be obtained with a diffuser cone angle as great as about 25° to about 30°.

Figure 21:
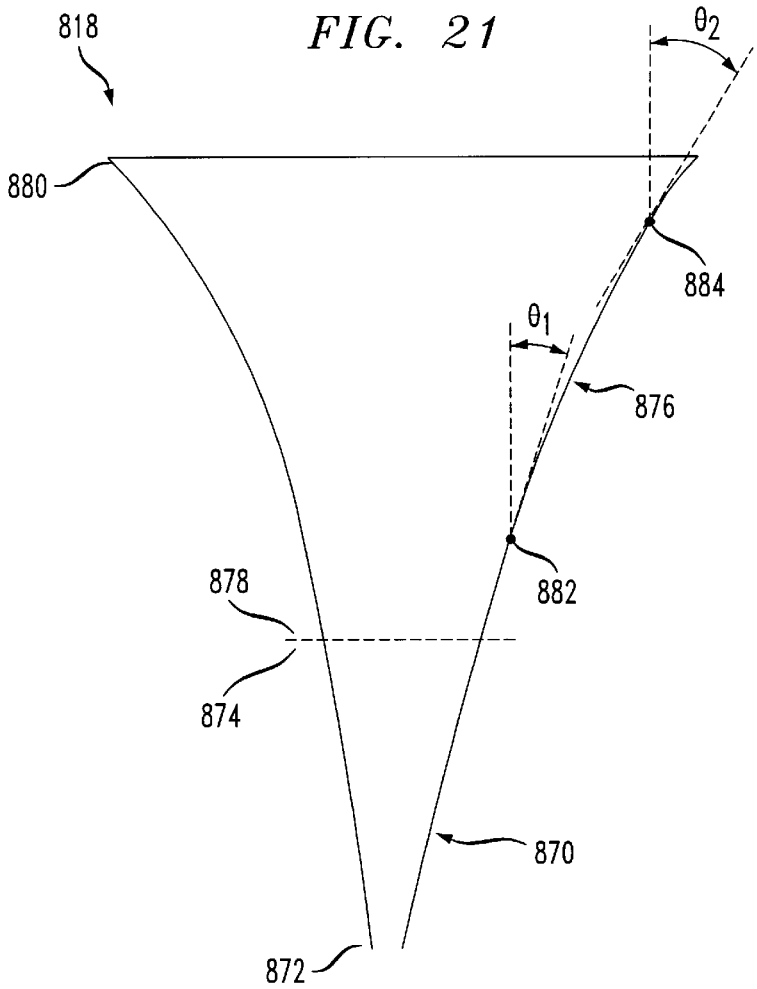
FIG. 21 depicts a further embodiment of a diffuser in accordance with the present teachings.

Illustrative diffuser 518 has a constant cone angle (e.g. 15 degrees). In a further embodiment depicted in FIG. 21, first portion 870 of diffuser 818 has a constant cone angle and second portion 876 of the diffuser 818 has an increasing cone angle. Compare cone half-angle $\theta_1$ at location 882 on the surface of the diffuser nearer beginning 878 of second portion 876 with cone half-angle $\theta_2$ at location 884 on the surface of the diffuser nearer outlet 880 of second portion 876.

In first portion 870, a relatively moderate cone angle (e.g., 10°–17°) aids in establishing the desired flow profile in diffuser 818. Once established, the cone angle can be progressively increased while maintaining the desired flow profile. Increasing the cone angle reduces the length of the diffuser (given a target diameter near the outlet of the diffuser). Since abrupt transitions at the wall of the diffuser will disrupt the flow profile, the cone angle at beginning 878 of second portion 876 is advantageously equal to the cone angle at end 874 of first portion 870.

Selecting cone angles for the first and second portion of the diffuser is an application specific task. More particularly, the cone angle is dependent on the gas feed rate, the powder feed rate and the electric charge. By way of illustration, not limitation, the cone angle for first portion 870 is typically in the range of about 10° to about 17°. The cone angle at beginning 878 of second portion 876 is typically in the range of about 10° to about 17° and the cone angle near end 880 of second portion 876 is typically in the range of about 25° to about 35°.

Figure 22:
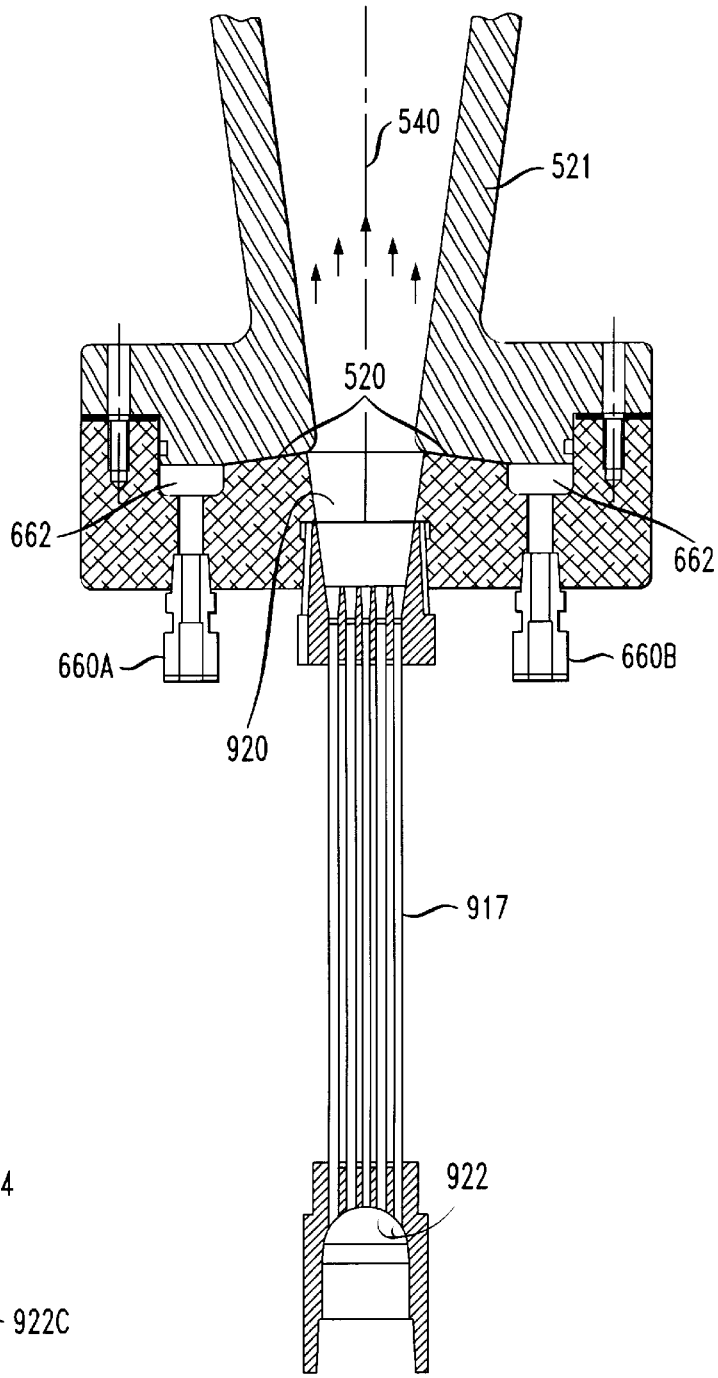
FIG. 22 depicts an illustrative flow straightener for use in conjunction with the present diffuser.
Figure 23:
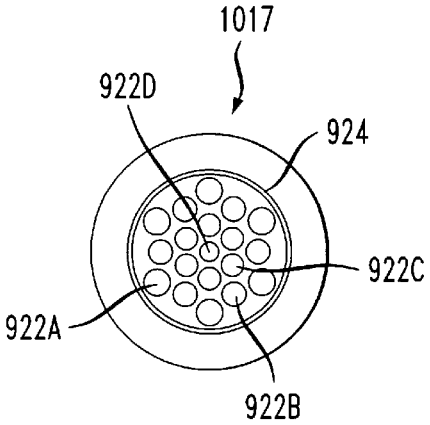
FIG. 23 depicts a cross-sectional end-view depicts tubes within a flow straightener.

It was previously stated that in some embodiments of the present invention, a flow straightener is used in conjunction with the diffuser to "tailor" or adjust the flow profile within the diffuser. FIGS. 22 and 23 depict embodiments of a flow straightener suitable for tailoring the flow profile of powder-laden gas 540 in the diffuser.

FIG. 22 depicts flow straightener 917 engaged to diffuser 518. Transitional region 920 between the flow straightener and the diffuser reduces the likelihood of flow instabilities (e.g., powder settling out of powder-laden gas 540, etc.). Flow straightener 917 comprises a plurality of tubes 922. Tubes 922 have a length-to-diameter ratio (L/D) in the range of about 10/1 to 60/1. Passing powder-laden gas 540 through such tubes results in a relatively flat flow profile as the powder-laden gas 540 enters diffuser 518.

It has been discovered that the flow profile of the powder-laden gas near the outlet of the diffuser is dependent, to some extent, on the flow profile of the powder-laden gas before such gas enters the diffuser. Therefore, in some embodiments, flow straightener 917 is advantageously used to tailor the flow profile of the powder-laden gas 540, as desired.

In one embodiment, the flow profile of powder-laden gas 540 is tailored by providing a variation in the diameter of tubes 922 within flow straightener 917. FIG. 23, which shows a cross-sectional end view of a flow straightener 1017, depicts an embodiment wherein the diameter of tubes 922 increase with increasing radial distance from the central axis of the flow straightener. Thus, tube 922D, aligned with the central axis, has the smallest diameter, six tubes 922C have a somewhat larger diameter than tube 922D, six tubes 922B have a larger diameter than tubes 922C, and six tubes 922A near wall 924 of the flow straightener have the largest diameter.

The arrangement depicted in FIG. 23 generally increases the velocity of the gas near wall 521 as compared to a flow straightener having tubes of equal diameter. Thus, such an approach can be used to flatten the flow profile across the diffuser if a particular diffuser design exhibits an unacceptable radial velocity gradient. In other embodiments, other arrangements of tubes of unequal diameter are used to cause other changes in the flow profile in the diffuser as desired.

It was previously indicated that a "focusing electrode" is advantageously used in conjunction with the electrostatic chuck to deposit powder on substrate 8. An embodiment of such a focusing electrode 1152 is depicted in FIG. 24 (side view) and FIG. 25 (bottom view of electrostatic chuck).

Figure 24:
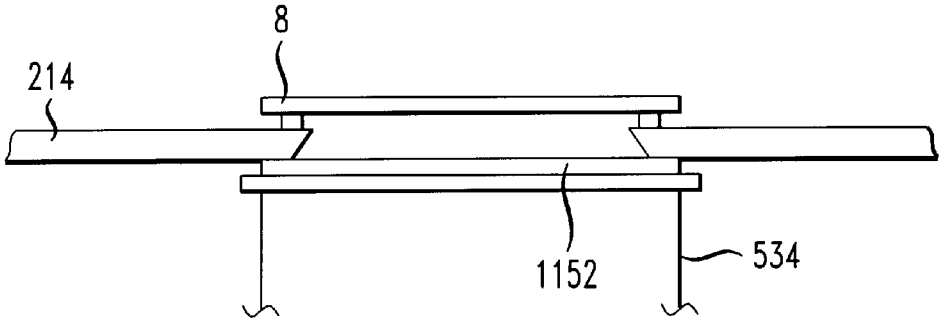
FIG. 24 depicts a side view of a focusing electrode for use in conjunction with electrostatic deposition.

In the embodiment depicted in FIG. 24, focusing electrode 1152 is located near substrate 8. The focusing electrode is configured for easy removal, such as for cleaning, etc.

Figure 25:
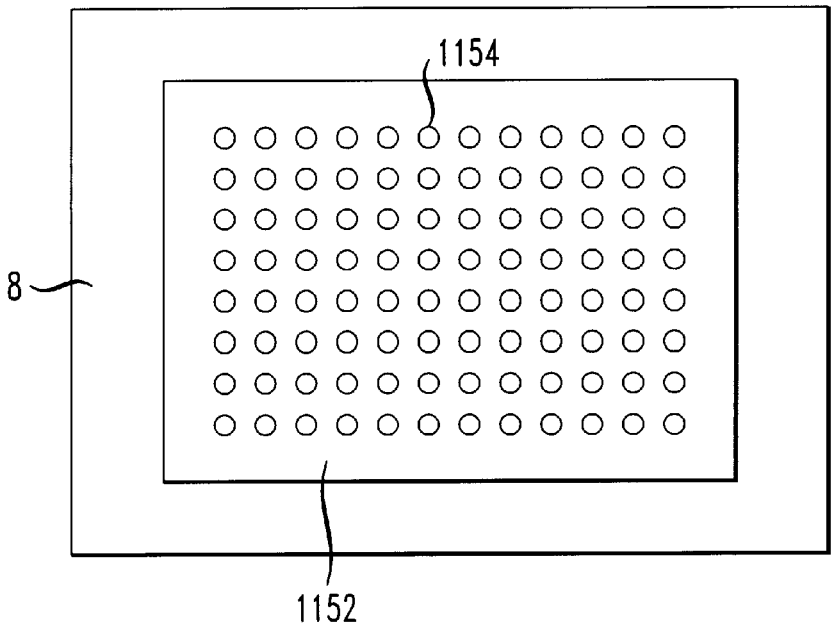
FIG. 25 depicts the focusing electrode as viewed from the bottom of the electrostatic chuck.

In the embodiment shown in FIG. 25, focusing electrode 1152 comprises a dielectric material coated with a conductor, such as copper. Electrode 1152 includes a plurality of openings 1154 aligned with the collection zones (not shown) of electrostatic chuck 302. Electrode 1152 is in contact with a controlled voltage source (not shown) operable to place a charge on the conductor that has the same polarity as the charge on the powder. Powder is thus "steered" away from the conductor and through holes 1154 to substrate 8.

It is to be understood that the above-described embodiments are merely illustrative of the invention and that many variations may be devised by those skilled in the art without departing from the scope of the invention. It is therefore intended that such variations be included within the scope of the following claims and their equivalents.

What is claimed is:

1. An apparatus for electrostatically depositing powder on a substrate, comprising:

a powder-feed apparatus for directing the powder to said substrate, said powder-feed apparatus comprising:

a diffuser; and a powder-delivery system that delivers said powder, carried in a first gas, to said diffuser, the powder-delivery system including a powder-charging system that imparts electrical charge to said powder, wherein:

said diffuser is operable to:

receive the electrically-charged powder from said powder-delivery system; and reduce a velocity of said first gas and said electrically-charged powder to an extent that electrostatic forces control motion of said electrically-charged powder, drawing said electrically-charged powder to said substrate.

2. The apparatus of claim 1 wherein a cone angle of said diffuser is about 10 to about 17 degrees.

3. The apparatus of claim 1 further comprising at least one flow-control feature that improves uniformity of flow of said first gas and said electrically-charged powder through said diffuser.

4. The apparatus of claim 3 wherein said one flow-control feature comprises a boundary-layer gas injector.

5. The apparatus of claim 4 wherein said boundary-layer gas injector comprises at least a first annular slit in a wall of said diffuser through which a second gas is injected into said boundary layer.

6. The apparatus of claim 5 wherein said boundary-layer gas injector provides a second momentum to said second gas, wherein said second momentum is greater than a first momentum of a portion of said first gas that flows in said boundary layer.

7. The apparatus of claim 5 wherein said boundary-layer gas injector further comprises an annular channel that is in fluid communication with said annular slit, wherein said second gas is injected into said annular channel.

8. The apparatus of claim 7 wherein said boundary-layer gas injector further comprises at least two nozzles that inject said second gas into said annular channel.

9. The apparatus of claim 8 wherein said boundary-layer gas injector further comprises flow control means for independently controlling flow of said second gas through said two nozzles.

10. The apparatus of claim 1 wherein said one flow-control feature comprises a boundary-layer gas aspirator.

11. The apparatus of claim 10 wherein said boundary-layer gas aspirator comprises:

at least a first annular slit in a wall of said diffuser; and a pressure-differential generating means that creates a pressure differential across said first annular slit so that at least some of said first gas in said boundary layer is removed through said first annular slit.

12. The apparatus of claim 11 wherein said pressure-differential generating means comprises:

a pressure-tight enclosure that isolates said first annular slit from an ambient environment; and a suction-flow-generating means in fluid communication with said pressure-tight enclosure.

13. The apparatus of claim 3 wherein a cone angle of said diffuser is in a range of about 15 to about 30 degrees.

14. The apparatus of claim 1 wherein said diffuser comprises:

a first section having an inlet and an outlet and characterized by a constant cone angle; and a second section having an inlet adjacent to said outlet of said first section, the second section extending to an outlet of said diffuser, said second section characterized by a variable cone angle that increases from a minimum at said inlet of said second section to a maximum at said outlet of the diffuser.

15. The apparatus of claim 14 wherein:

said constant cone angle is in a range of about 10 to about 17 degrees;

said variable cone angle is in a range of about 10 to about 17 degrees at said inlet of said second section;

and said variable cone angle is in a range of about 25 to about 30 degrees at said outlet of the diffuser.

16. The apparatus of claim 1 further comprising a flow straightener that receives said electrically-charged powder carried in said first gas and delivers it to said diffuser, wherein said flow straightener is operable to flatten a velocity profile of said first gas.

17. The apparatus of claim 16 wherein said flow straightener comprises a plurality of tubes through which said first gas and said electrically-charged powder flows.

18. The apparatus of claim 17 wherein said tubes have a length-to-diameter ratio in a range of about 10:1 to about 60:1.

19. The apparatus of claim 17 wherein at least some of said tubes have a different diameter than other of said tubes.

20. The apparatus of claim 19 wherein a tube aligned with a central longitudinal axis of said straightener has a smaller diameter than a tube located off of said central longitudinal axis.

21. The apparatus of claim 1 further comprising an electrostatic chuck having one or more collection zones, each of which collection zones is operable, in conjunction with a bias source, to generate said electrostatic forces, and further wherein:

said substrate is detachably engaged to said electrostatic chuck and overlies said collection zones.

22. The apparatus of claim 21 further comprising:

sensors that are operable to obtain data indicative of a quantity of powder that is deposited at each collection zone;

a boundary-layer gas injector comprising:

at least one annular slit in a wall of said diffuser through which a second gas is injected into said boundary layer;

at least two nozzles that inject said second gas through said annular channel; and means for adjusting said injection of said second gas responsive to said data obtained by said sensors.

23. The apparatus of claim 21 further comprising:

an optical detection device for obtaining data indicative of an amount of said powder deposited on said substrate on regions overlying each collection zone.

24. The apparatus of claim 23 further comprising a transport element operable to move said electrostatic chuck:

to a first location to engage said substrate;

to a second location wherein said powder is deposited on said substrate; and to a third location for acquisition of measurement data by said optical detection device.

25. The apparatus of claim 1 wherein said powder delivery system comprises:

a drum for temporary storage of said powder;

a movable belt that receives said powder from said drum;

means for removing said powder off said movable belt; and means for receiving said removed powder and directing it towards said powder-charging feed tube.

26. The apparatus of claim 1 wherein said powder-charge system comprises a powder charging feed tube.

* * * * *